US011508518B2

(12) United States Patent
Wang et al.

(10) Patent No.: US 11,508,518 B2
(45) Date of Patent: Nov. 22, 2022

(54) COIL DEVICE WITH PREDETERMINED GAP ARRANGEMENT

(71) Applicant: TDK CORPORATION, Tokyo (JP)

(72) Inventors: Chen Wang, Tokyo (JP); Satoshi Sugimoto, Tokyo (JP); Leo Yao, Lincolnshire, IL (US)

(73) Assignee: TDK CORPORATION, Tokyo (JP)

( * ) Notice: Subject to any disclaimer, the term of this patent is extended or adjusted under 35 U.S.C. 154(b) by 414 days.

(21) Appl. No.: 16/794,454

(22) Filed: Feb. 19, 2020

(65) Prior Publication Data

US 2021/0257157 A1 Aug. 19, 2021

(51) Int. Cl.

| | |
|---|---|
| ***H01F 27/38*** | (2006.01) |
| ***H01F 17/04*** | (2006.01) |
| ***H01F 38/02*** | (2006.01) |
| ***H01F 27/29*** | (2006.01) |
| ***H01F 3/14*** | (2006.01) |

(52) U.S. Cl.

CPC ..... *H01F 27/38* (2013.01); *H01F 3/14* (2013.01); *H01F 17/04* (2013.01); *H01F 27/292* (2013.01); *H01F 38/023* (2013.01)

(58) Field of Classification Search

CPC . H01F 27/38; H01F 3/14; H01F 17/04; H01F 27/292; H01F 38/023

See application file for complete search history.

(56) References Cited

U.S. PATENT DOCUMENTS

| | | | | |
|---|---|---|---|---|
| 6,088,909 | A * | 7/2000 | Ouchi | G11B 5/1272 |
| 2008/0303624 | A1* | 12/2008 | Yamada | H01F 17/043 336/212 |
| 2020/0227200 | A1* | 7/2020 | Zheng | H01F 27/26 |
| 2021/0384787 | A1* | 12/2021 | Okamoto | H02K 15/024 |

FOREIGN PATENT DOCUMENTS

| | | | |
|---|---|---|---|
| JP | H03-035623 | A | 2/1991 |

* cited by examiner

*Primary Examiner* — Rafael O De Leon Domenech
(74) *Attorney, Agent, or Firm* — Oliff PLC

(57) ABSTRACT

A coil device includes a core and a plurality of coils arranged in the core. A distance of a second gap formed by portions of the core located inside at least one of the coils is larger than that of a first gap formed by other portions of the core located between the coils next to each other.

17 Claims, 18 Drawing Sheets

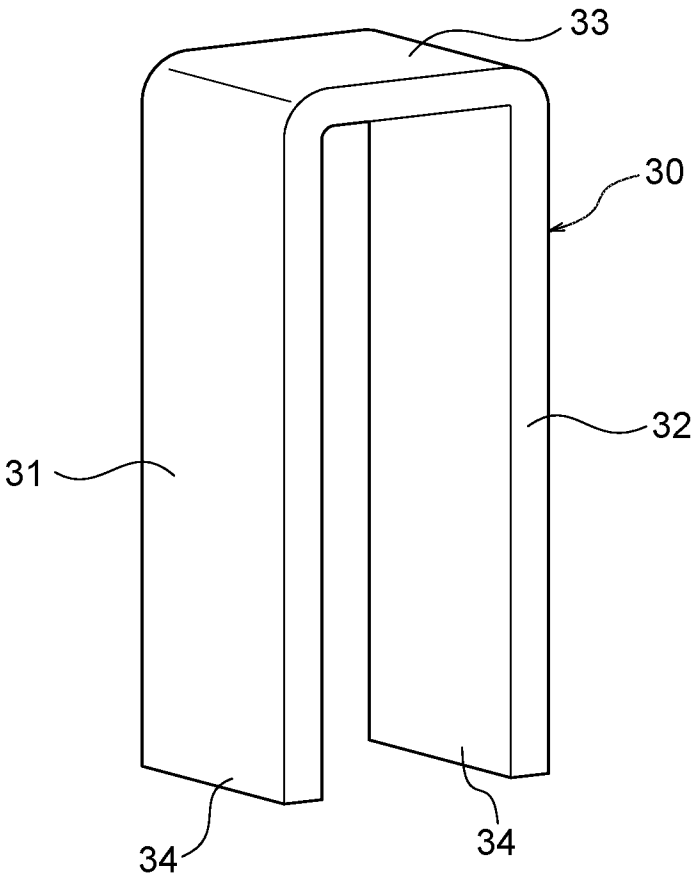
FIG. 3A
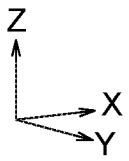

COIL DEVICE WITH PREDETERMINED GAP ARRANGEMENT

BACKGROUND OF THE INVENTION

The present invention relates to a coil device used as an inductor or so.

As a coil device used as an inductor or so, for example, a coil device of Patent Document 1 is known. In the coil device of Patent Document 1, multiple coils are arranged in two pairs of cores combined with gaps.

In the coil device of Patent Document 1, however, magnetic characteristics of each of the coils may deteriorate due to strong magnetic coupling between the coils next to each other.

Patent Document 1: JPH0335623 (A)

BRIEF SUMMARY OF INVENTION

The present invention has been achieved under such circumstances. It is an object of the invention to provide a coil device having a weak magnetic coupling between coils next to each other.

To achieve the above object, a coil device according to the present invention includes:

a core; and a plurality of coils arranged in the core;

wherein a distance of a second gap formed by portions of the core located inside at least one of the coils is larger than that of a first gap formed by other portions of the core located between the coils next to each other.

In the coil device according to the present invention, a distance of a second gap formed by portions of the core located inside at least one of the coils is larger than that of a first gap formed by other portions of the core located between the coils next to each other. Thus, the magnetic resistance of the second gap is larger than that of the first gap. As a result, a magnetic flux generated from one of the coils is hard to pass through its adjacent coil (i.e., the second gap with a higher magnetic resistance), but easily passes between the coils (i.e., the first gap with a lower magnetic resistance). Thus, the magnetic flux generated from one of the coils can be prevented from passing through its adjacent coil(s), and the magnetic coupling between the coils next to each other can be weak.

Since the magnetic coupling between the coils next to each other is weak, favorable magnetic characteristics can be obtained even if the multiple coils are closely arranged in the core, and the coil device can effectively be downsized.

Preferably, the first gap extends in a direction connecting the coils next to each other, and the second gap extends in a direction connecting portions of an inner circumferential surface of at least one of the coils. In this structure, most of the magnetic flux generated from one of the coils pass across the first gap formed between the one of the coils and its adjacent coil and also pass across the second gap formed inside the one of the coils, and the above-mentioned effects can effectively be obtained.

Preferably, the core includes an outer leg part formed between the coils next to each other and an inner leg part formed in at least one of the coils, the first gap is formed at the outer leg part, and the second gap is formed at the inner leg part. In this case, sufficient inductance characteristics can be obtained by passing a magnetic flux generated from one of the coils through the outer leg part and the inner leg part. The above-mentioned effects can be obtained by passing the magnetic flux generated from one of the coils through the first gap formed at the outer leg part and the second gap formed at the inner leg part.

Preferably, mountable parts connectable to an external circuit are formed on both ends of at least one of the coils. In this structure, the coils can easily be connected to an external circuit via the mountable parts.

The mountable parts may partly be exposed from a lateral surface of the core in its width direction. In this structure, a solder fillet can be formed on a part of each of the mountable parts exposed from the lateral surface of the core in mounting the coil device on an external circuit board, and the mounting strength of the coil device for the external circuit can be improved.

The mountable parts may not be exposed from a lateral surface of the core in its width direction. In this case, the mountable parts are simply structured (for example, the mountable parts do not need to have a protrusion part protruding from the lateral surface of the core). Thus, the coils can easily be arranged inside the core, and the coil device is easily manufactured.

Preferably, the mountable parts extend in an array direction of the plurality of coils. In this structure, the coil device can sufficiently be balanced via the mountable parts of each of the coils and can stably be mounted on an external circuit even if the coils have a small width.

Preferably, the mountable parts of either of the coils next to each other and the mountable parts of the other coil extend in substantially the same direction. In this structure, it is possible to have a sufficiently large distance between the mountable parts of either of the coils next to each other and the mountable parts of the other coil and to prevent short-circuit failure between the coils next to each other.

Preferably, the core includes a top board covering tops of the plurality of coils. In this structure, the top surface of the top board can be used as a suction surface, and the handling performance of the coil device can be improved.

Preferably, a width of at least one of the coils is larger than a length of at least one of the coils perpendicular to its height direction. In this structure, even if the multiple coils are arranged in the core, the core can be shorter in the array direction of the coils, and the coil device can be downsized (thinned).

The core may include a first core and a second core, the first core may have at least one outer leg part and a plurality of inner leg parts, the second core may have at least one outer leg part and a plurality of inner leg parts, the first gap may be formed between the outer leg part of the first core and the outer leg part of the second core, and the second gap may be formed between at least one of the inner leg parts of the first core and at least one of the inner leg parts of the second core. In this structure, when the first core and the second core are combined, the first gap and the second gap can easily be formed, and the above-mentioned effects can easily be obtained.

The core may include an E-shaped core and a plate-shaped core. In this structure, the first gap and the second gap can be formed at positions where the legs of the E-shaped core and the plate surface of the flat core are combined. In this case, effects similar to those of Second Embodiment are also obtained.

BRIEF DESCRIPTION OF DRAWINGS

FIG. 3A is a perspective view of a coil of the coil device shown in FIG. 1A.

DETAILED DESCRIPTION OF INVENTION

Hereinafter, the present invention is explained based on embodiments shown in the figures.

First Embodiment

Figure 1A:
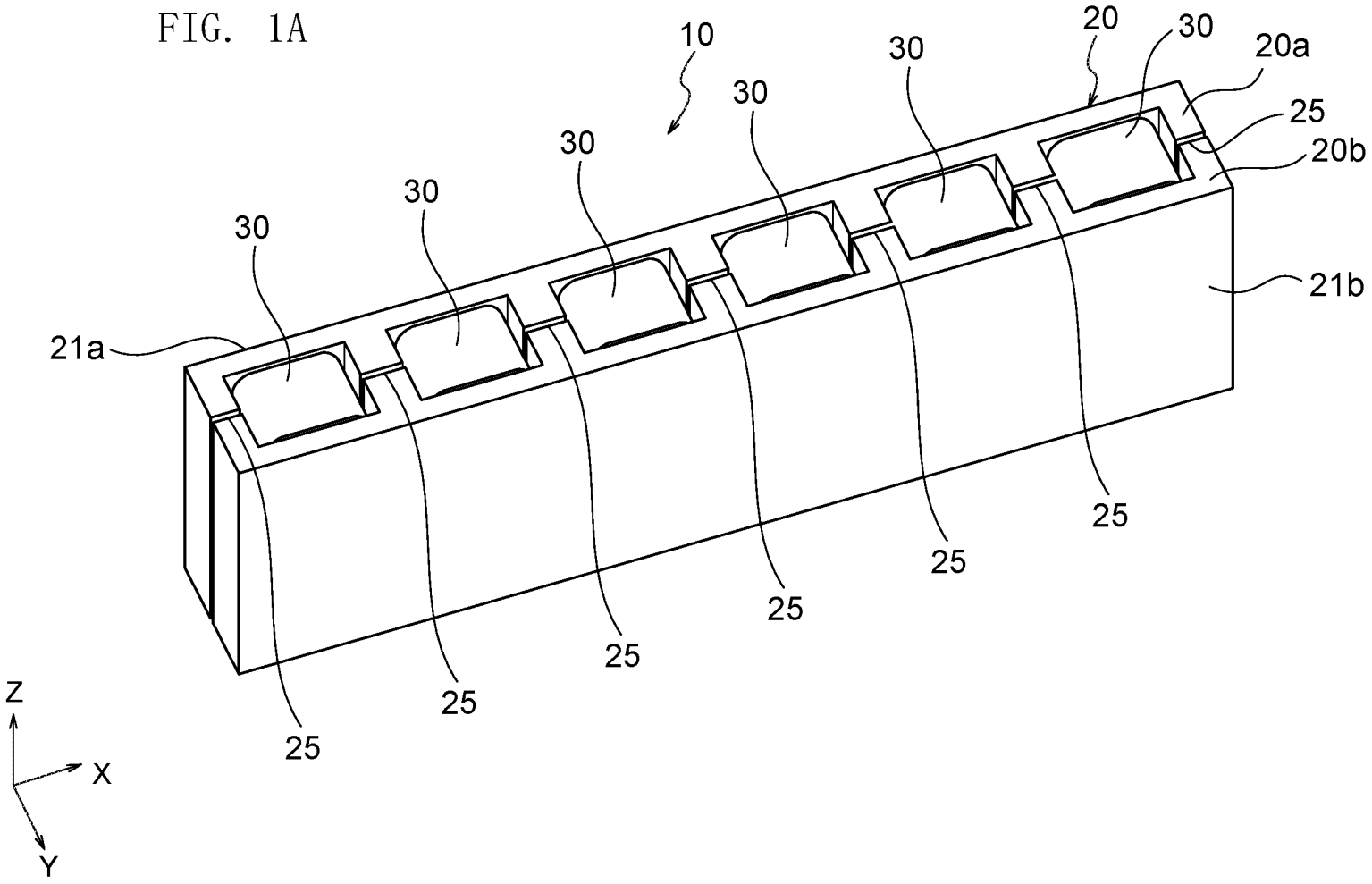
FIG. 1A is a perspective view of a coil device according to First Embodiment of the present invention.

As shown in FIG. 1A, a coil device 10 includes a core 20 having a substantially rectangular parallelepiped outer shape and a plurality of coils 30 (six coils in the illustrated example) arranged in the core 20. The coil device 10 is, for example, an inductor and has an array structure where the multiple coils 30 are arrayed in the X-axis direction. The coil device 10 has any size. For example, the coil device 10 can have a length of 3-20 mm in each axis direction.

As shown in FIG. 3A, each of the coils 30 is made from a substantially U-shaped conductor plate. For example, the coils 30 are made from a metal good conductor of copper, copper alloy, silver, nickel, etc., but may be made from any other conductor material. For example, the coils 30 are formed by machining a metal plate, but may be formed by any other method. In the illustrated example, each of the coils 30 is shorter in the Y-axis direction than in the X-axis direction and in the Z-axis direction.

Each of the coils 30 has a first lateral surface part 31, a second lateral surface part 32, an upper surface part 33, and mountable parts 34. Each of the first lateral surface part 31 and the second lateral surface part 32 extends in the Z-axis direction. In each of the coils 30, the first lateral surface part 31 is an input terminal (or an output terminal), and the second lateral surface part 32 is an output terminal (or an input terminal). In the multiple coils 30 as an example of FIG. 1A, the first lateral surface parts 31 are located on the negative side in the X-axis direction, and the second lateral surface parts 32 are located on the positive side in the X-axis direction. Each of the upper surface parts 33 extends in the X-axis direction and connects a pair of first lateral surface part 31 and second lateral surface part 32.

In the present embodiment, as shown in FIG. 3A, both ends of each of the coils 30 (i.e., lower ends of the first lateral surface part 31 and the second lateral surface part 32) are used as the mountable parts 34, and the coils 30 can be connected with an external circuit (not illustrated) of a mounting board. When the coils 30 are arranged in the core 20 (an assembly of a first core 20*a* and a second core 20*b*) as shown in FIG. 1A, parts of each of the coils 30 protruding outward (downward) from the bottom of the first core 20*a* in the Z-axis direction function as the mountable parts 34 as shown in FIG. 4. Incidentally, the coils 30 are bonded with an external circuit (not illustrated) using, for example, a connection member of solder, conductive adhesive, etc.

In the present embodiment, as shown in FIG. 1A, the core 20 is formed from the first core 20*a* and the second core 20*b*, and the first core 20*a* and the second core 20*b* are arranged to face each other in the Y-axis direction. The shape of the second core 20*b* corresponds to that of the first core 20*a* (the same shape in the illustrated example). The cores 20*a* and 20*b* are bonded using adhesive or so. The core 20 is made from a magnetic material and is manufactured by, for example, molding and sintering a magnetic material having a comparatively high permeability (e.g., Ni—Zn based ferrite, Mn—Zn based ferrite) or a magnetic powder composed of a metal magnetic material or so.

Figure 2A:
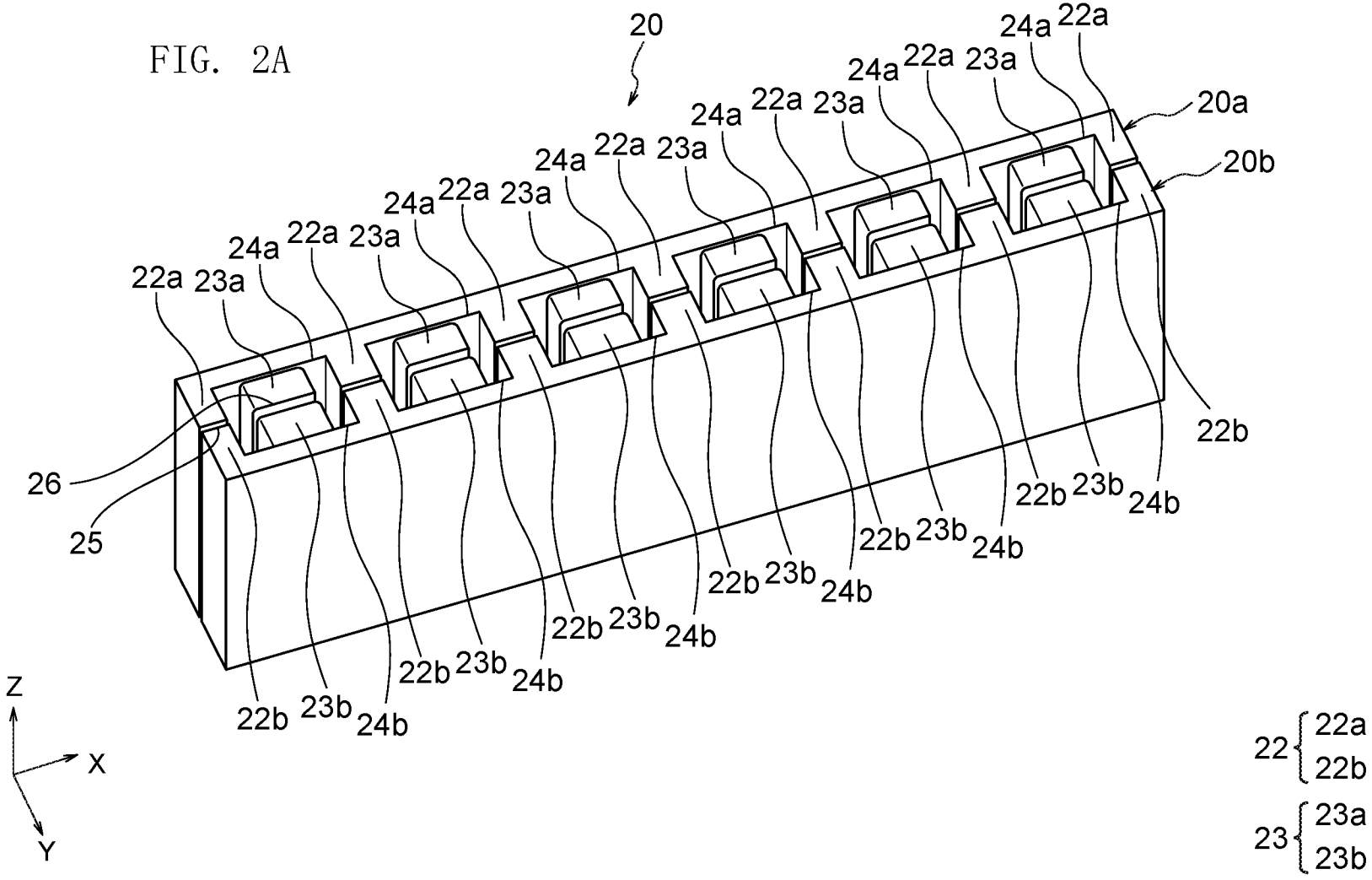
FIG. 2A is a perspective view of a core (first core and second core) of the coil device shown in FIG. 1A.
Figure 2B:
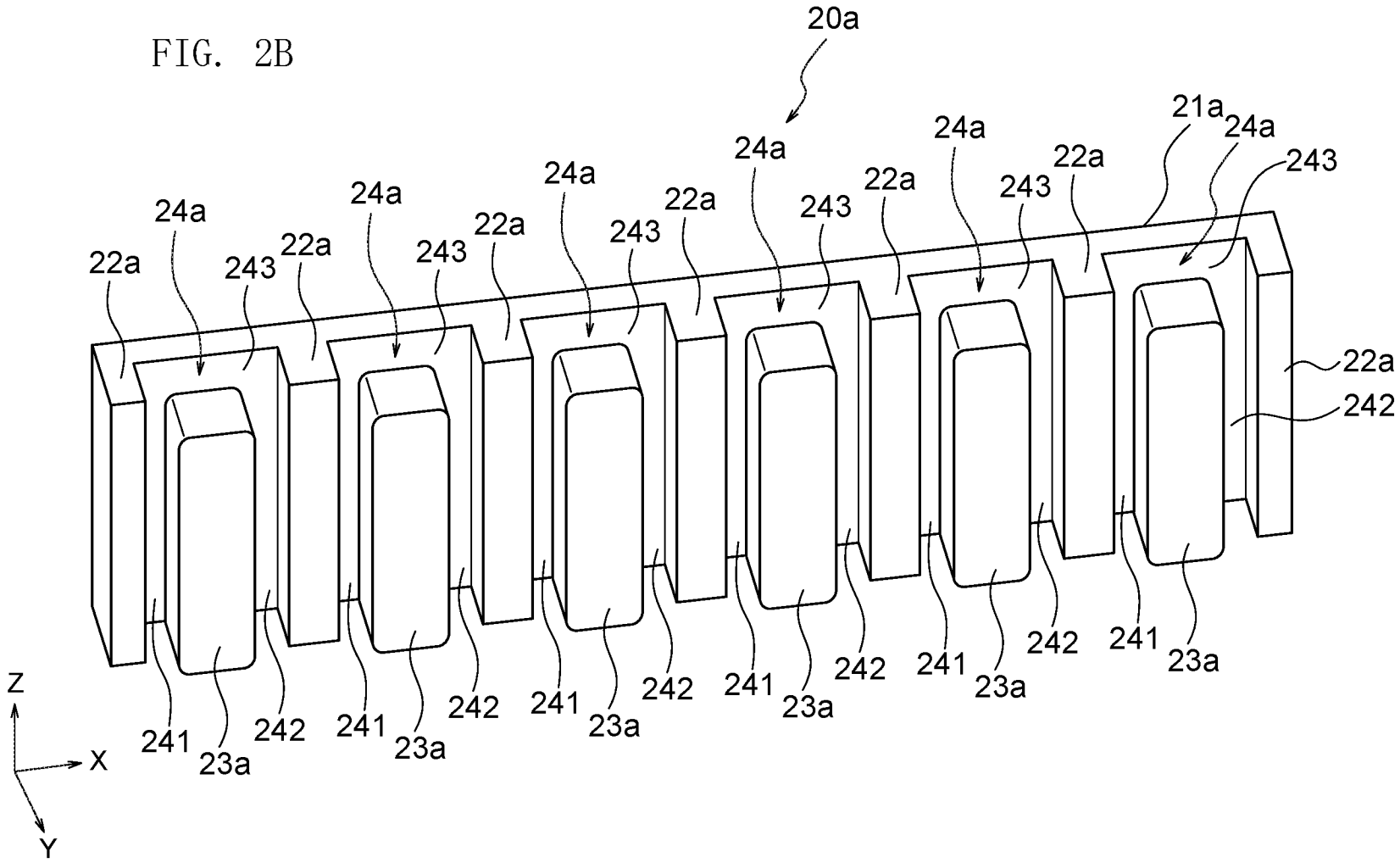
FIG. 2B is a perspective view of the core (first core) shown in FIG. 2A.

As shown in FIG. 2B, the first core 20*a* has a first base part 21*a*, a plurality of first outer leg parts 22*a* (seven first outer leg parts 22*a* in the illustrated example), a plurality of first inner leg parts 23*a* (six first inner leg parts 23*a* in the illustrated example), and a plurality of first groove parts 24*a* (six first groove parts 24*a* in the illustrated example). The first base part 21*a* has a substantially plate shape (substantially rectangular parallelepiped shape).

Each of the first outer leg parts 22*a* protrudes from a surface of the first base part 21*a* on one side in the Y-axis direction toward one side in the Y-axis direction by a predetermined length. Each of the first outer leg parts 22*a* has a slender shape in the Z-axis direction and extends from the upper end to the lower end of the first base part 21*a* in the Z-axis direction. As shown in FIG. 2B and FIG. 4, the multiple first outer leg parts 22*a* are formed between the coils 30 next to each other at predetermined intervals in the X-axis direction on a surface of the first base part 21*a* on one side in the Y-axis direction.

Figure 1B:
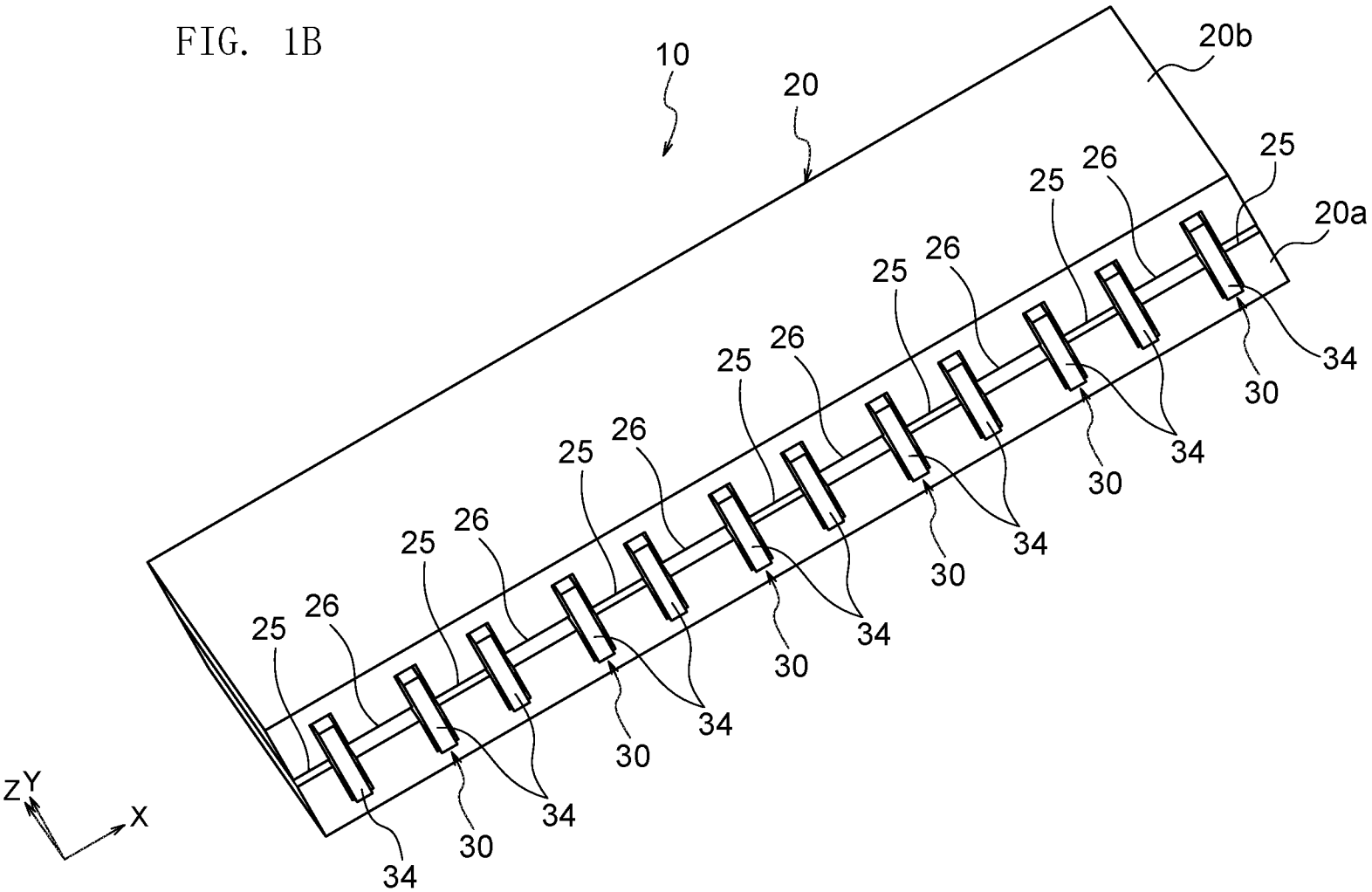
FIG. 1B is a perspective view of the coil device shown in FIG. 1A from a different angle.
Figure 1C:
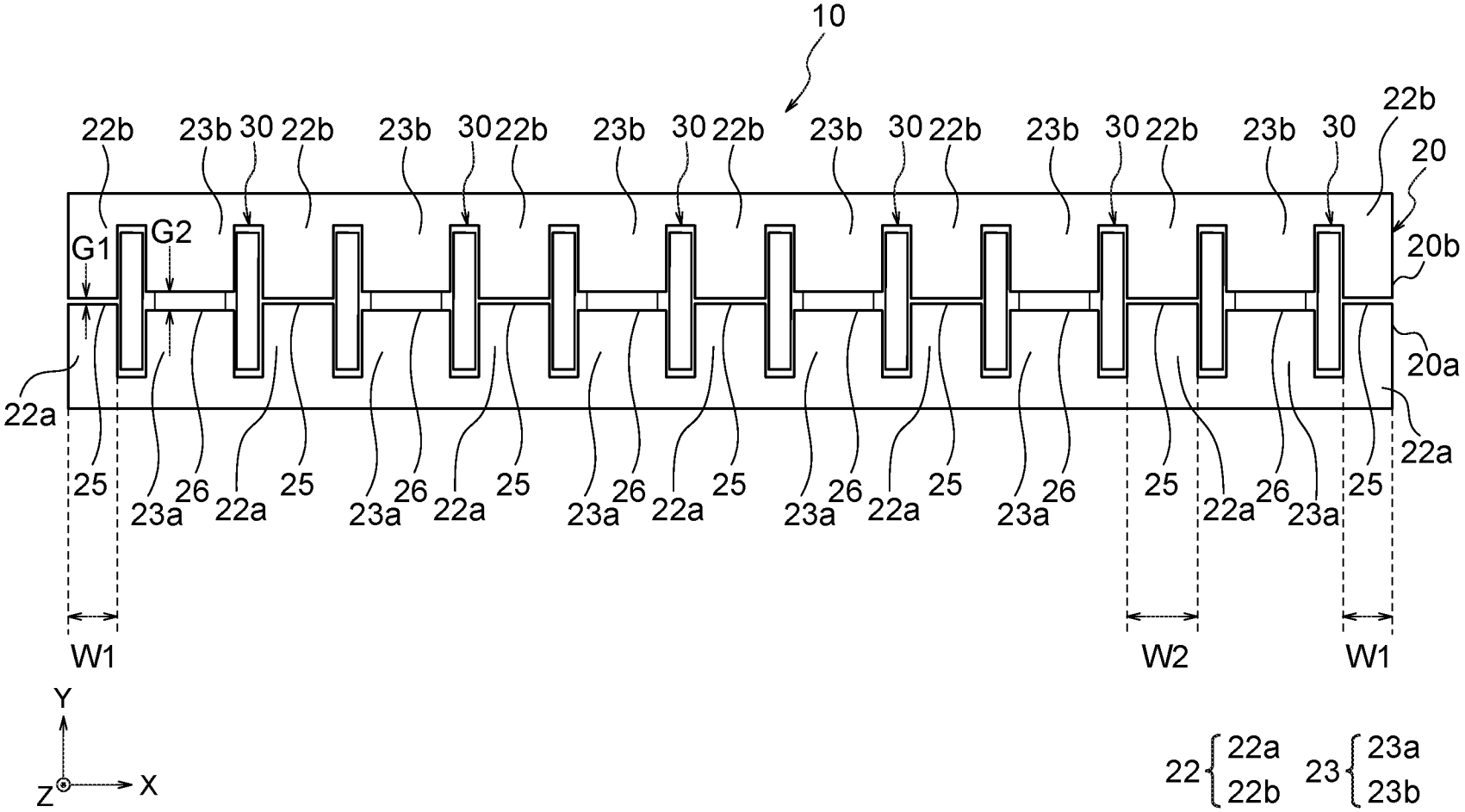
FIG. 1C is a bottom view of the coil device shown in FIG. 1A.

As shown in FIG. 1C, a width W1 in the X-axis direction of each of the two first outer leg parts 22*a* located on both ends of the first core 20*a* in the X-axis direction is smaller than a width W2 in the X-axis direction of each of the five first outer leg parts 22*a* located between the two first outer leg parts 22*a*.

In FIG. 1A to FIG. 1C, the ratio W2/W1 of the width W2 to the width W1 is preferably 1.5-2.5 (more preferably 1.8-2.2, still more preferably 2), provided that the first lateral surface part 31 and the second lateral surface part 32 of each of the coils 30 arranged next to each other shown in FIG. 3A are an input terminal (output terminal) and an output terminal (input terminal), respectively. In this case, both a magnetic flux generated in either of the coils 30 arranged next to each of the first outer leg parts 22*a* defined by the width W2 and a magnetic flux generated in the other coil 30 pass toward the same direction in each of the first outer leg parts 22*a*. Thus, when the ratio W2/W1 is within the above range, the magnetic flux generated in each of the coils 30 easily passes through the first outer leg parts 22*a* defined by the width W2, and magnetic saturation of the coil device 10 can effectively be prevented.

The ratio W2/W1 of the width W2 to the width W1 is preferably 0.5-1.5 (more preferably 0.8-1.2, still more preferably 1), provided that among the coils 30 arranged next to each other, the first lateral surface part 31 and the second lateral surface part 32 of either of the coils 30 are respectively an input terminal (output terminal) and an output terminal (input terminal), and the first lateral surface part 31 and the second lateral surface part 32 of the other coil 30 are respectively an output terminal (input terminal) and an input terminal (output terminal). In this case, both a magnetic flux generated in either of the coils 30 arranged next to each of the first outer leg parts 22*a* defined by the width W2 and a magnetic flux generated in the other coil 30 pass toward different directions in each of the first outer leg parts 22*a*. Thus, even if the width W2 is comparatively small, the magnetic flux generated in each of the coils 30 can sufficiently pass through the first outer leg parts 22*a* defined by the width W2. When the ratio W2/W1 is within the above range, the width of each of the first outer leg parts 22*a* in the X-axis direction defined by the width W2 can comparatively be small, and the coil device 10 can be downsized.

As shown in FIG. 2B, the first inner leg parts 23*a* protrude from a surface of the first base part 21*a* on one side in the Y-axis direction toward one side in the Y-axis direction by a predetermined length. The first inner leg parts 23*a* have a slender shape in the Z-axis direction and extend from an upper part (a position that is substantially below the upper end by the thickness of the coils 30) to the lower end of the first base part 21*a* in the Z-axis direction. The first inner leg parts 23*a* are formed at predetermined intervals in the X-axis direction on the surface of the first base part 21*a* on one side in the Y-axis direction. For more detail, as shown in FIG. 2B and FIG. 4, the first inner leg parts 23*a* are formed inside the coils 30. The protrusion width of each of the first inner leg parts 23*a* in the Y-axis direction is larger than that of each of the first outer leg parts 22*a* in the Y-axis direction. In the illustrated example of FIG. 2B, the width of each of the first inner leg parts 23*a* in the X-axis direction is larger (substantially twice) than that of each of the first outer leg parts 22*a* in the X-axis direction.

Each of the first inner leg parts 23*a* is disposed between the multiple first outer leg parts 22*a*. Each of the first groove parts 24*a* is formed between either of the first outer leg parts 22*a* next to each other in the X-axis direction and each of the first inner leg parts 23*a* formed therebetween.

Each of the first groove parts 24*a* has a shape corresponding to that of each of the coils 30 and extends around each of the first inner leg parts 23*a*. The coils 30 can be arranged in the first groove parts 24*a*. Each of the first groove parts 24*a* has a first lateral part 241, a second lateral part 242, and a top part 243.

The first lateral part 241 and the second lateral part 242 substantially linearly extend from the upper end to the lower end of the first base part 21*a* in the Z-axis direction. Each of the first lateral part 241 and the second lateral part 242 is formed between the first outer leg parts 22*a* and the first inner leg parts 23*a*. Each width of the first lateral part 241 and the second lateral part 242 in the X-axis direction is as large as or larger than the thickness (plate thickness) of each of the coils 30. As shown in FIG. 4, the first lateral surface parts 31 of the coils 30 are arranged in the first lateral parts 241, and the second lateral surface parts 32 of the coils 30 are arranged in the second lateral parts 242.

As shown in FIG. 2B, the top parts 243 are formed on the top of the first base part 21*a* and extend in the X-axis direction. Each of the top parts 243 connects the upper end of each of the first lateral parts 241 and the upper end of each of the second lateral parts 242. The width of each of the top parts 243 in the Z-axis direction is as large as or larger than the thickness (plate thickness) of each of the coils 30. As shown in FIG. 4, the upper surface parts 33 of the coils 30 are arranged in the top parts 243.

When the coils 30 are arranged in the first groove parts 24*a*, the first inner leg parts 23*a* are arranged inside the coils 30, and the first outer leg parts 22*a* are arranged between the coils 30 next to each other. That is, the coils 30 are divided by the first outer leg parts 22*a* arranged between the coils 30. The coils are hung and fixed by the first inner leg parts 23*a* in the core 20 (the first core 20*a* and the second core 20*b*).

As shown in FIG. 2A, the second core 20*b* has a second base part 21*b* corresponding to the first base part 21*a*, a plurality of second outer leg parts 22*b* corresponding to the plurality of first outer leg parts 22*a*, a plurality of second inner leg parts 23*b* corresponding to the plurality of first inner leg parts 23*a*, and a plurality of second groove parts 24*b* corresponding to the plurality of first groove parts 24*a*.

The first outer leg parts 22*a* and the second outer leg parts 22*b* constitute the outer leg parts 22, and the first inner leg parts 23*a* and the second inner leg parts 23*b* constitute the inner leg parts 23. The first core 20 and the second core 20*b* constitute the core 20. The first core 20*a* and the second core 20*b* are combined in the Y-axis direction.

When the first core 20*a* and the second core 20*b* are combined as shown in FIG. 1A to FIG. 1C, the mountable parts 34 are not exposed from lateral surfaces of the core 20*a* (each of the first core 20*a* and the second core 20*b*) in the width direction (Y-axis direction) and are contained in the core 20 in the Y-axis direction.

As shown in FIG. 1C, the mountable parts 34 of the coils 30 (the mountable parts 34 located at the lower ends of the first lateral parts 241 and the mountable parts 34 located at the lower ends of the second lateral parts 242) are only exposed (protrude) from the bottom surface of the core 20 (specifically, the lower ends of the first lateral parts 241 and the lower ends of the second lateral parts 242 shown in FIG. 2B). Since the mountable parts 34 are exposed from the bottom surface of the core 20, heat generated near the mountable parts 34 can efficiently be discharged to the outside of the core 20.

As shown in FIG. 1C and FIG. 2A, when the first core 20*a* and the second core 20*b* are combined by facing each other in the Y-axis direction, first gaps 25 having a predetermined width in the Y-axis direction are formed at the outer leg parts 22, and second gaps 26 having a predetermined width in the Y-axis direction are formed at the inner leg parts 23, between the first core 20*a* and the second core 20*b*.

As shown in FIG. 1A, the first core 20*a* and the second core 20*b* can be combined by bonding one surface of the first core 20*a* located on the other side of the first base part 21*a* in the Y-axis direction and one surface of the second core 20*b* located on the other side of the second base part 21*b* in the Y-axis direction using adhesive or so (not illustrated). For more detail, the outer leg parts 22*a* and 22*b* and/or the inner leg parts 23*a* and 23*b* of the cores 20*a* and 20*b* are bonded with each other.

As shown in FIG. 1B, FIG. 1C, and FIG. 2A, the first gaps 25 have a predetermined length in the X-axis direction and are formed between the first outer leg parts 22*a* and the second outer leg parts 22*b* (at the outer leg parts 22). The length of the first gaps 25 in the X-axis direction corresponds (is equal) to the length of the outer leg parts 22*a* and 22*b* in the X-axis direction. The first gaps 25 also have a predetermined length in the Z-axis direction corresponding (equal) to a length of the outer leg parts 22*a* and 22*b* in the Z-axis direction.

The first gaps 25 are formed at predetermined intervals in the X-axis direction by corresponding to the arrangement position of the outer leg parts 22*a* and 22*b*. The distance of each of the first gaps 25 in the Y-axis direction is constant in the X-axis direction or the Z-axis direction.

The second gaps 26 have a predetermined length in the X-axis direction and are formed between the first inner leg parts 23*a* and the second inner leg parts 23*b* (at the inner leg parts 23). The length of the second gaps 26 in the X-axis direction corresponds (is equal) to the length of the inner leg parts 23*a* and 23*b* in the X-axis direction. In the illustrated example, the length of the second gaps 26 in the X-axis direction is smaller than that of the first gaps 25 in the X-axis direction. The second gaps 26 also have a predetermined length in the Z-axis direction corresponding (equal) to a length of the first inner leg parts 23*a* and 23*b* in the Z-axis direction.

The second gaps 26 are formed at predetermined intervals in the X-axis direction by corresponding to the arrangement position of the inner leg parts 23*a* and 23*b*. The distance of each of the second gaps 26 in the Y-axis direction is constant in the X-axis direction or the Z-axis direction.

The first gaps 25 and the second gaps 26 are arranged alternately in the X-axis direction by interposing the first lateral parts 241 or the second lateral parts 242 and are formed colinearly along the boarder line between the first core 20*a* and the second core 20*b*.

The length in the X-axis direction of each of the first gaps 25 formed on both ends of the core 20 in the X-axis direction is smaller than that of each of the five first gaps 25 formed inside the first gaps 25. The second gaps 26 are formed inside the coils 30 and located (interposed) between the first lateral surface parts 31 and the second lateral surface parts 32 shown in FIG. 3A.

In the present embodiment, a distance in the Y-axis direction of the second gaps 26 of the core 20 located inside the coils 30 is larger than that of the first gaps 25 of the core 20 located between the coils 30 next to each other. That is, among the gaps formed between the first core 20*a* and the second core 20*b*, the first gaps 25 constitute narrow parts, and the second gaps 26 constitute wide parts. The magnetic resistance of the second gaps 26 is larger than that of the first gaps 25.

As shown in FIG. 1C, a distance G1 in the Y-axis direction of each of the first gaps 25 is preferably 0.03-0.3 mm (more preferably, 0.03-0.2 mm), and a distance G2 in the Y-axis direction of each of the second gaps 26 is preferably 0.1-1.0 mm (more preferably, 0.1-0.5 mm).

When the coils 30 are arranged inside the core 20, each of the first gaps 25 extends in a direction connecting the coils 30 next each other (the X-axis direction in the present embodiment). Although not illustrated in detail, when the coils 30 are arranged inside the core 20, each of the second gaps 26 extends in a direction connecting portions of an inner circumferential surface of each of the coils 30 (the X-axis direction in the present embodiment).

In the manufacture of the coil device 10, the first core 20*a* and the second core 20*b* with a shape corresponding to that of the first core 20*a* shown in FIG. 2A are prepared, and a plurality of coils 30 shown in FIG. 3A (six coils in the present embodiment) is prepared. Then, the coils 30 are arranged in the first groove parts 24*a* (second groove parts 24*b*) of the first core 20*a* (second core 20*b*).

Next, the coil device 10 shown in FIG. 1A to FIG. 1C is obtained by bonding the first core 20*a* (second core 20*b*) and the second core 20*b* (first core 20*a*) with adhesive etc. so that the second groove parts 24*b* (first groove parts 24*a*) of the second core 20*b* (first core 20*a*) are overlapped and arranged in the first groove parts 24*a* (second groove parts 24*b*) of the first core 20*a* (second core 20*b*). Incidentally, the multiple coils 30 may be arranged in the core 20 from above the core 20 (from where the top parts 243 are formed) after the core 20 is formed in advance by bonding the first core 20*a* and the second core 20*b* with adhesive or so.

In the coil device 10 according to the present embodiment, a distance of each of the second gaps 26 of the core 20 located inside the coils 30 is larger than that of each of the first gaps 25 of the core 20 located between the coils 30 next to each other. Thus, the magnetic resistance of the second gaps 26 is larger than that of the first gaps 25. As a result, a magnetic flux generated from one of the coils 30 is hard to pass through its adjacent coil(s) 30 (i.e., the second gaps 26 with a higher magnetic resistance), but easily passes between the coils 30 (i.e., the first gaps 25 with a lower magnetic resistance). Thus, the magnetic flux generated from one of the coils 30 can be prevented from passing through its adjacent coil(s) 30, and the magnetic coupling between the coils 30 next to each other can be weak.

Since the magnetic coupling between the coils 30 next to each other is weak, favorable magnetic characteristics can be obtained even if the multiple coils 30 are closely arranged in the core 20, and the coil device 10 can effectively be downsized.

In the present embodiment, each of the first gaps 25 extends in a direction connecting the coils 30 next to each other, and each of the second gaps 26 extends in a direction connecting portions of an inner circumferential surface of each of the coils 30. Thus, most of the magnetic flux generated from one of the coils 30 pass across the first gaps 25 formed between the one of the coils 30 and its adjacent coil(s) 30 and also pass across the second gap 26 formed inside the one of the coils 30, and the above-mentioned effects can effectively be obtained.

In the present embodiment, the core 20 has the outer leg parts 22 formed between the coils 30 next to each other and the inner leg parts 23 formed inside the coils 30, the first gaps 25 are formed at the outer leg parts 22, and the second gaps 26 are formed at the inner leg parts 23. In this case, sufficient inductance characteristics can be obtained by passing a magnetic flux generated from one of the coils 30 through the outer leg parts 22 and the inner leg parts 23. The above-mentioned effects can be obtained by passing the magnetic flux generated from one of the coils 30 through the first gaps 25 formed at the outer leg parts 22 and the second gaps 26 formed at the inner leg parts 23.

In the present embodiment, the mountable parts 34 connectable to an external circuit are formed on both ends of each of the coils 30. Thus, the coils 30 can easily be connected to an external circuit via the mountable parts 34.

In the present embodiment, the core 20 is formed from the first core 20*a* and the second core 20*b*, the first core 20*a* has at least one first outer leg part 22*a* and a plurality of first inner leg parts 23*a*, and the second core 20*b* has at least one second outer leg part 22*b* and a plurality of second inner leg parts 23*b*. Then, the first gaps 25 are formed between the outer leg parts 22 (first outer leg parts 22*a*) of the first core 20*a* and the outer leg parts 22 (second outer leg parts 22*b*)

of the second core 20*b*, and the second gaps 26 are formed between the inner leg parts 23 (first inner leg parts 23*a*) of the first core 20*a* and the inner leg parts 23 (second inner leg parts 23*b*) of the second core 20*b*. Thus, when the first core 20*a* and the second core 20*b* are combined, the first gaps 25 and the second gaps 26 can easily be formed, and the above-mentioned effects can easily be obtained.

In the present embodiment, the mountable parts 34 are not exposed from a lateral surface of the core in the width direction (Y-axis direction). In this case, the mountable parts 34 are simply structured (for example, like a coil 130 shown in FIG. 7, the mountable parts 34 do not need to have a protrusion part 340). Thus, the coils 30 can easily be arranged inside the core 20 (for example, the coils 30 are put into the core 20 from above), and the coil device 10 is easily manufactured.

Second Embodiment

Except for the following matters, a coil device 110 according to Second Embodiment of the present invention is similar to the coil device 10 according to First Embodiment and demonstrates similar effects. Their overlapping matters are not explained. In the figures, common members are provided with common references.

Figure 5A:
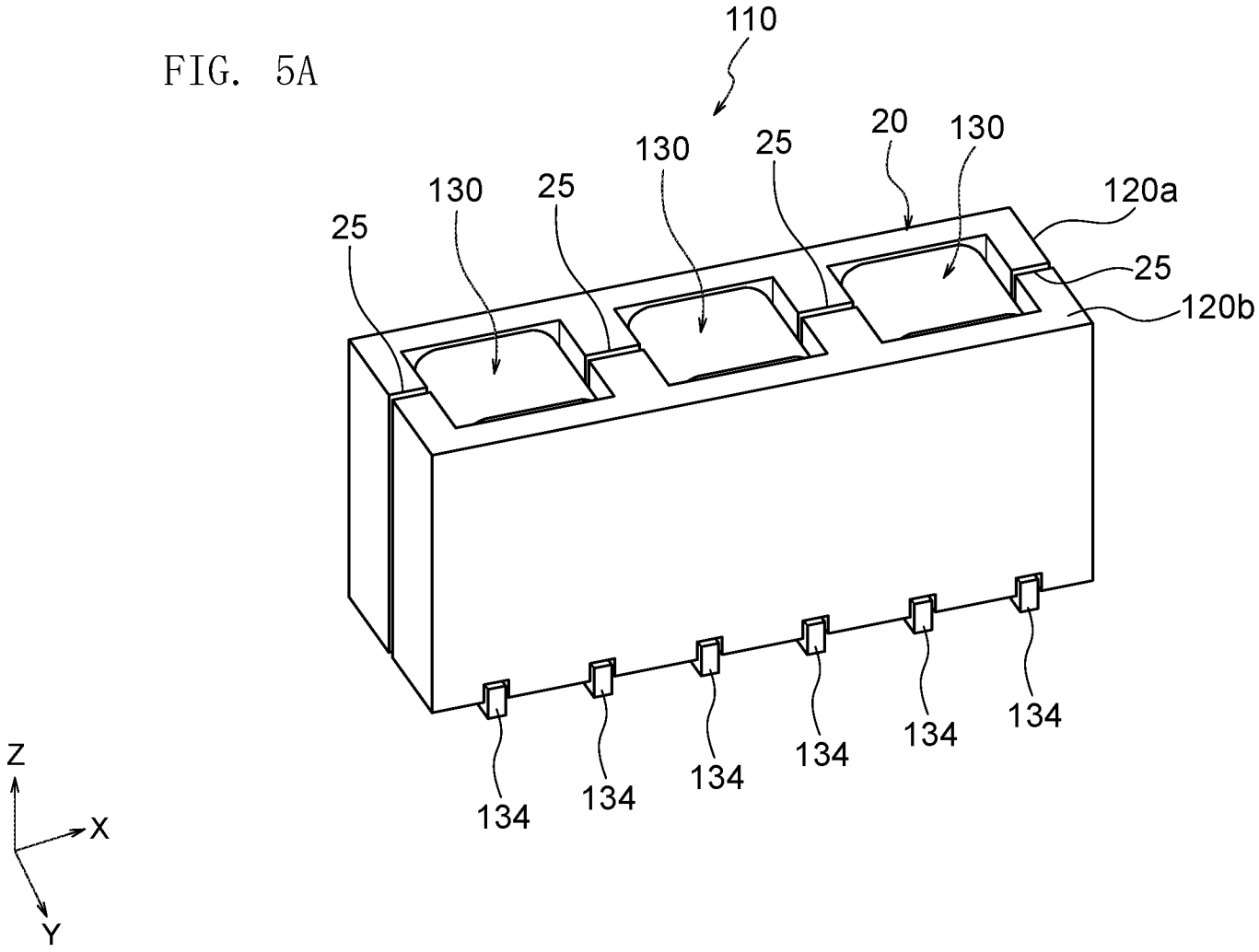
FIG. 5A is a perspective view of a coil device according to Second Embodiment of the present invention.
Figure 6:
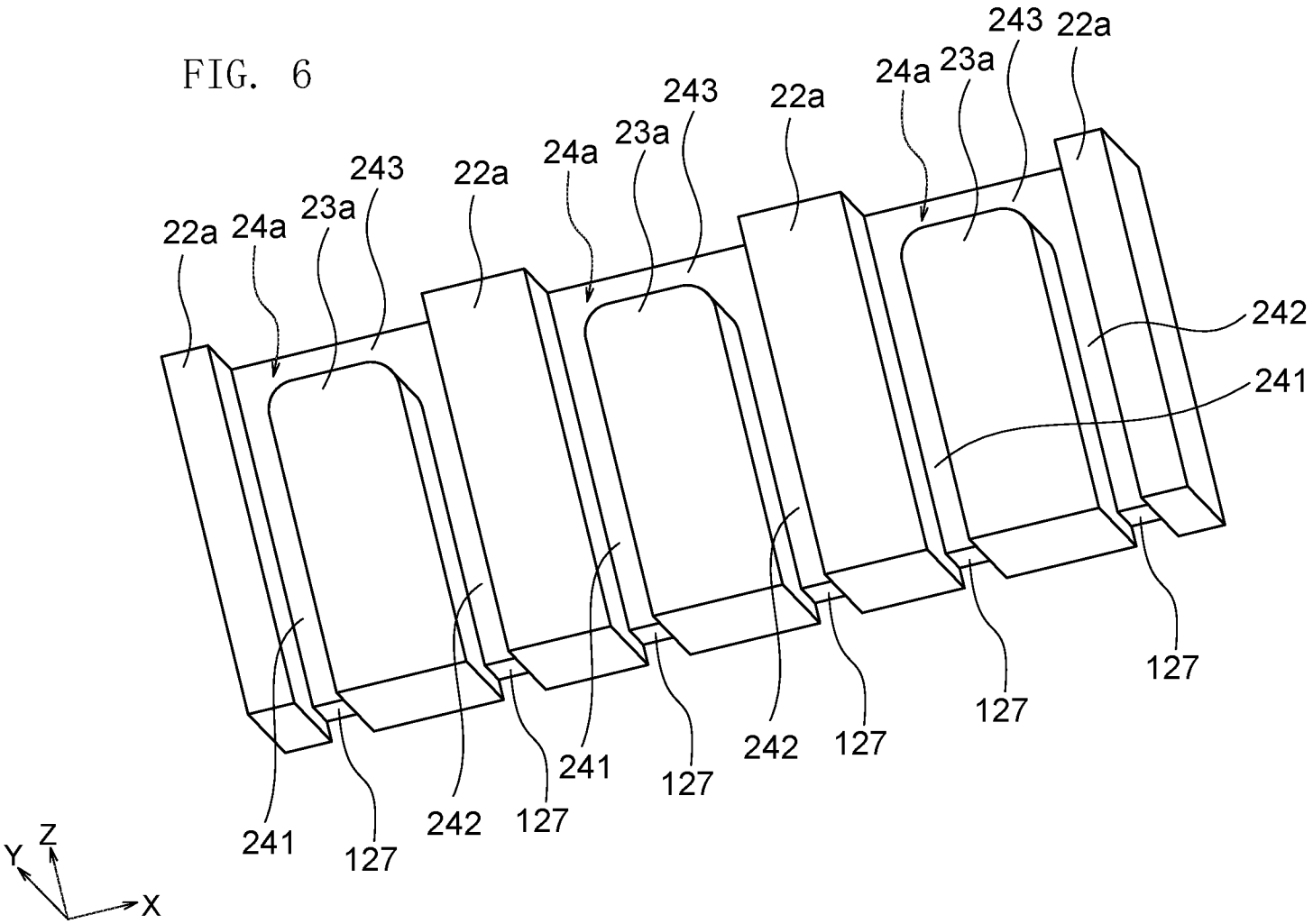
FIG. 6 is a perspective view of the core (first core) of the coil device shown in FIG. 5A.

As shown in FIG. 5A, the coil device 110 includes a core 120 and a plurality of coils 130 (three coils in the present embodiment). The core 120 is formed from a first core 120*a* and a second core 120*b* and is structured by combining the first core 120*a* and the second core 120*b*. The first core 120*a* is different from the first core 20*a* according to First Embodiment (see FIG. 2B) in that the first core 120*a* has notches 127 as shown in FIG. 6. Incidentally, the shape of the second core 120*b* is similar to that of the first core 120*a*, and the second core 120*b* is not thereby explained hereinafter.

In FIG. 2B, each of the notches 127 is formed by cutting off the lower end of the first base part 21*a* located between the first outer leg part 22*a* and the first inner leg part 23*a* in the Y-axis direction. Each of the notches 127 is formed continuously to the lower end of the first lateral part 241 or the second lateral part 242. A mountable part 134 of the coil 130 shown in FIG. 7 can partly (protrusion parts 340 mentioned below) be inserted into each of the notches 127.

Figure 7:
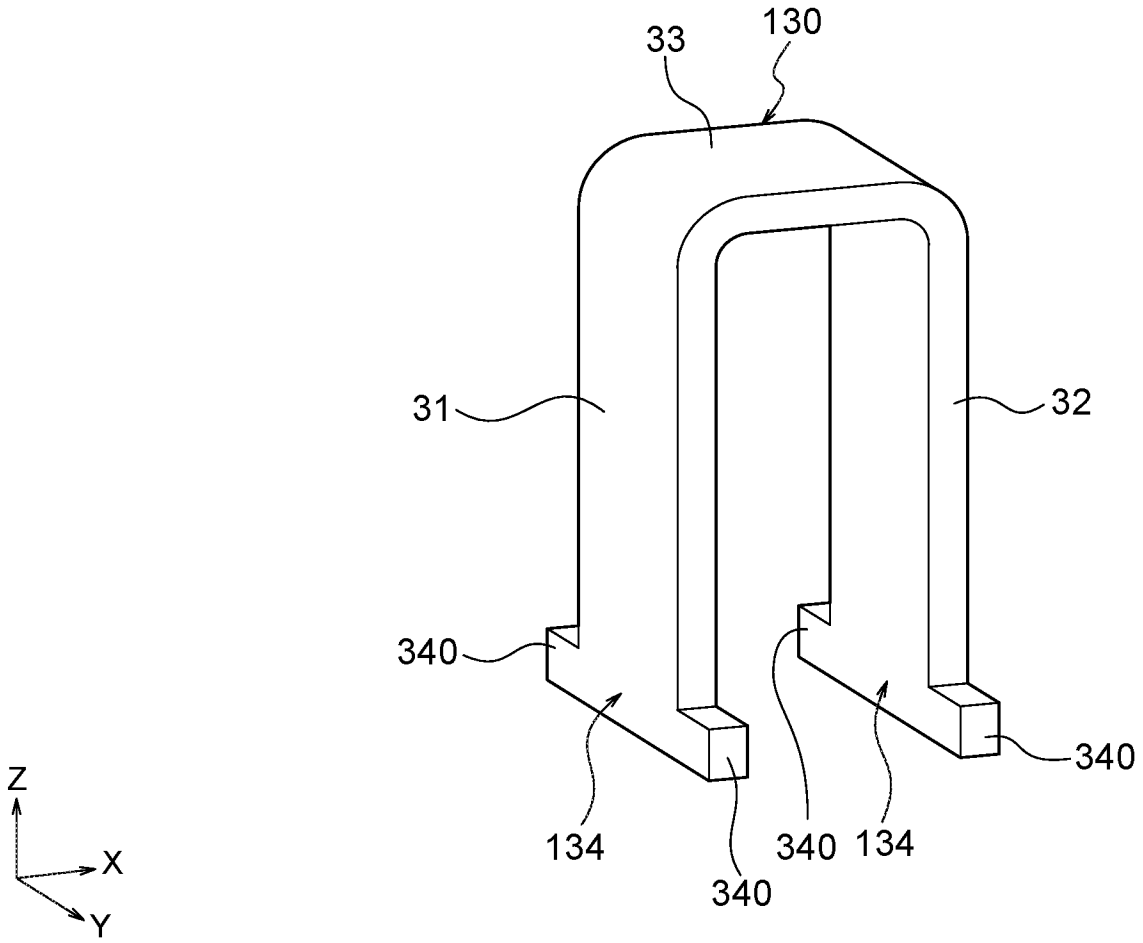
FIG. 7 is a perspective view of a coil of the coil device shown in FIG. 5A.

As shown in FIG. 7, each of the coils 130 has the mountable parts 134. The mountable parts 134 are different from the mountable parts 34 according to First Embodiment in that each of the mountable parts 134 has a plurality of protrusion parts 340 (four protrusion parts in the illustrated example).

Among the two protrusion parts 340 owned by the mountable part 134 of the first lateral surface part 31, either of the protrusion parts 340 is located on one side of the mountable part 134 in the Y-axis direction and protrudes toward one side in the Y-axis direction, and the other protrusion part 340 is located on the other side of the mountable part 134 in the Y-axis direction and protrudes toward the other side in the Y-axis direction.

Among the two protrusion parts 340 owned by the mountable part 134 of the second lateral surface part 32, either of the protrusion parts 340 is located on one side of the mountable part 134 in the Y-axis direction and protrudes toward one side in the Y-axis direction, and the other protrusion part 340 is located on the other side of the mountable part 134 in the Y-axis direction and protrudes toward the other side in the Y-axis direction.

The protrusion width of each of the protrusion parts 340 in the Y-axis direction is substantially equal to a length of each of the above-mentioned notches 127 in the Y-axis direction. The protrusion parts 340 are arranged in the notches 127.

In the present embodiment, as shown in FIG. 5A, the protrusion parts 340 are exposed from the lateral surfaces of the core 120 in the width direction (Y-axis direction). For more detail, the protrusion parts 340 located on one side of the mountable parts 134 in the Y-axis direction shown in FIG. 7 are exposed (protrude) to the outside in the Y-axis direction from the lower end of the first base part 21*a* of the first core 120*a* shown in FIG. 5A, and the protrusion parts 340 located on the other side of the mountable parts 134 in the Y-axis direction shown in FIG. 7 are exposed (protrude) to the outside in the Y-axis direction from the lower end of the second base part 21*b* of the second core 120*b* shown in FIG. 5A.

Figure 5B:
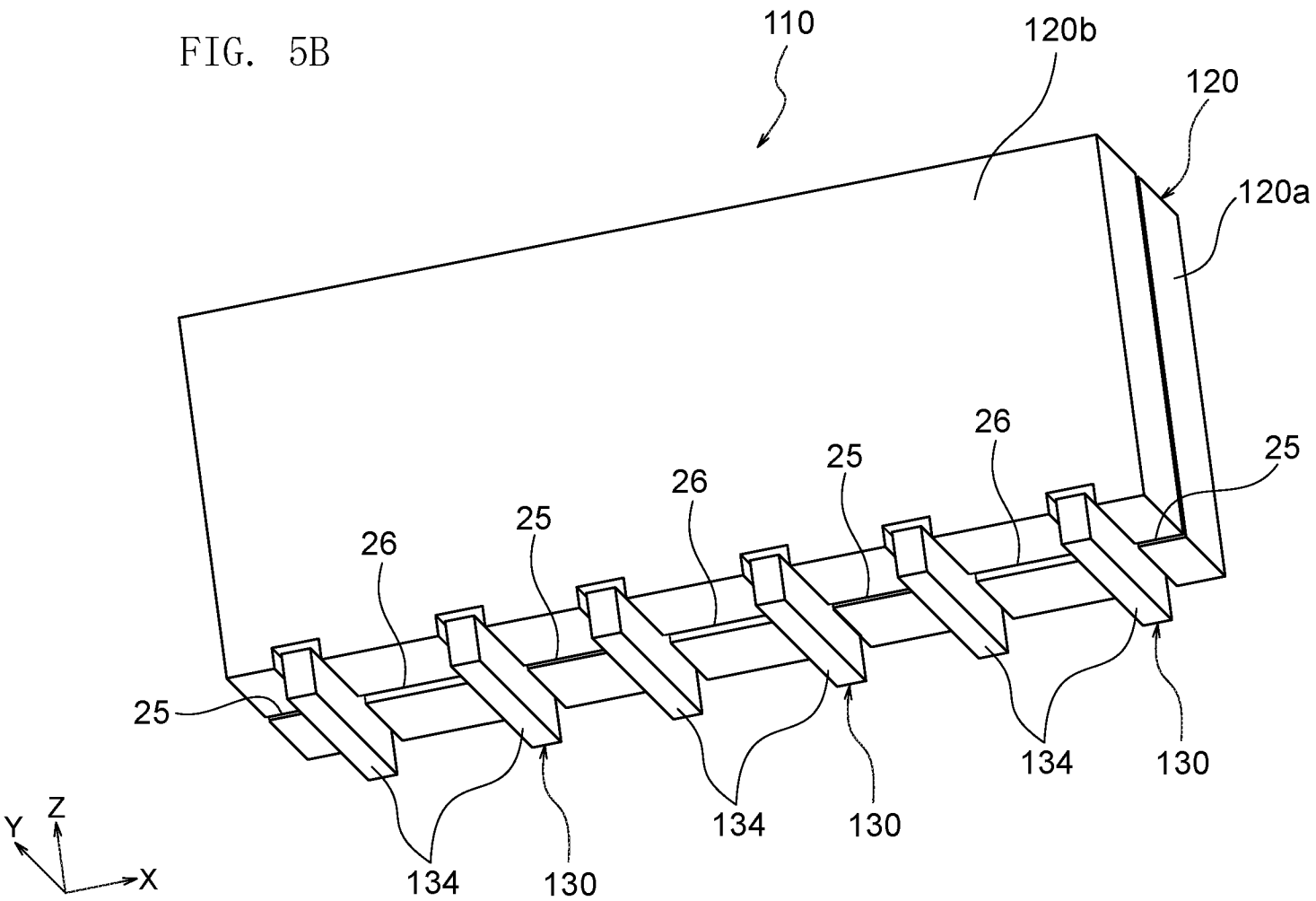
FIG. 5B is a perspective view of the coil device shown in FIG. 5A from a different angle.

As shown in FIG. 5B, the mountable parts 134 protrude downward in the Z-axis direction from the bottom surface of the core 120. The protrusion width of each of the mountable parts 134 is as large as or smaller than the height of each of the protrusion parts 340 in the Z-axis direction. In each of mountable parts 134, the width of the coil 130 in the Y-axis direction is substantially equal to that of the core 120 in the Y-axis direction.

In the present embodiment, each of the mountable parts 134 is partly (protrusion parts 340) exposed from the lateral surfaces of the core 120 in the width direction. Thus, a solder fillet can be formed on a part of each of the mountable parts 134 (protrusion parts 340) exposed from the lateral surfaces of the core 120 in mounting the coil device 110 on an external circuit board, and the mounting strength of the coil device 110 for the external circuit can be improved. Based on the state of the solder fillets formed on the mountable parts 340, the bonding state of solder for the mountable parts 134 can be confirmed.

In the present embodiment, the coil 130 (mountable parts 134) becomes wider by the mountable parts 340, and it is thereby possible to shorten the wiring (land) of the external circuit and to reduce DC resistance (DCR).

Since each of the mountable parts 134 has the mountable parts 340, the mountable parts 134 become wider in the Y-axis direction. Thus, when the coil device 110 is mounted on the external circuit, it is possible to improve the stability in mounting position and to stably mount the coil device 110 on the external circuit.

Third Embodiment

Except for the following matters, a coil device 210 according to Third Embodiment of the present invention is similar to the coil device 10 according to First Embodiment and demonstrates similar effects. Their overlapping matters are not explained. In the figures, common members are provided with common references.

Figure 8:
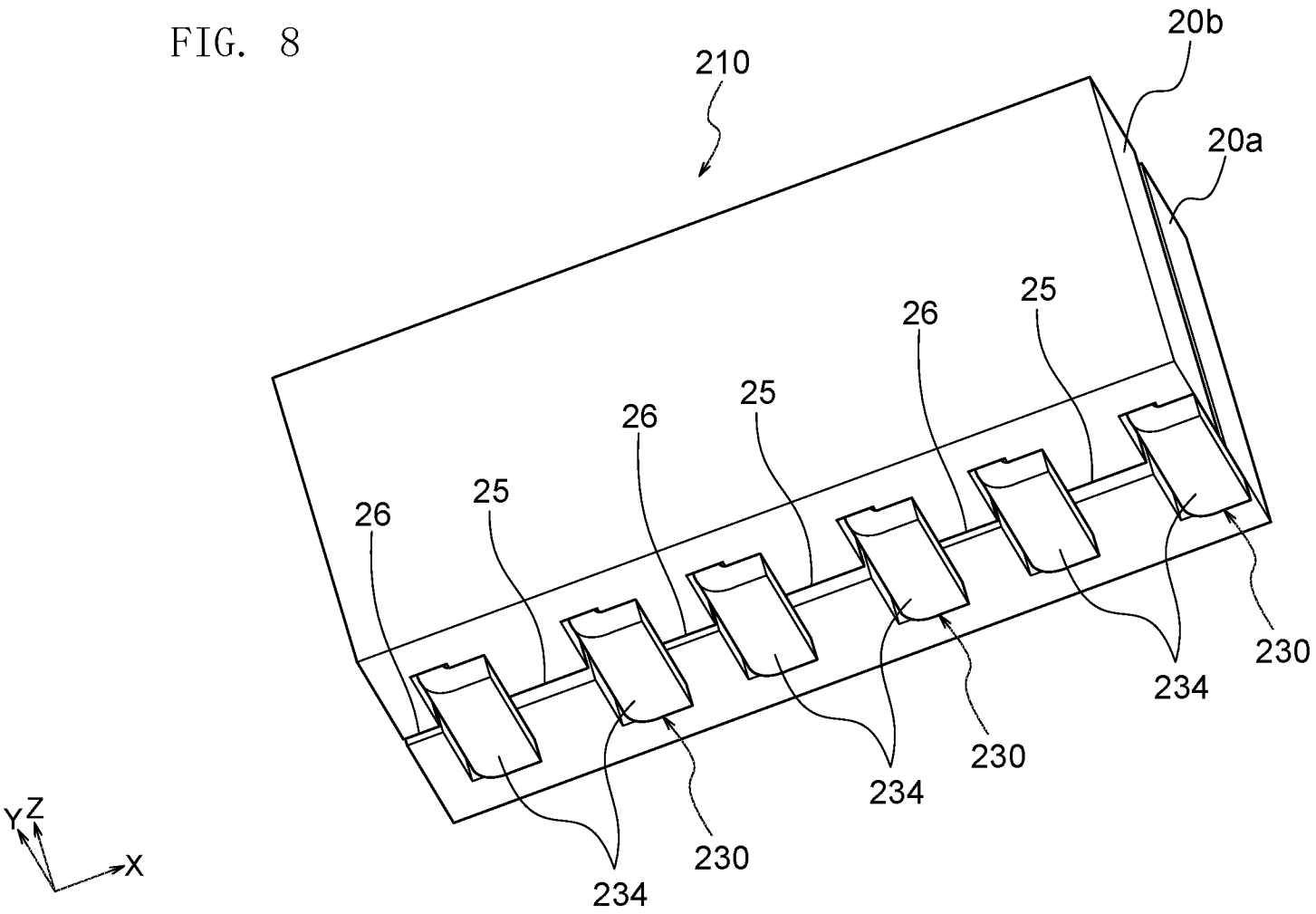
FIG. 8 is a perspective view of a coil device according to Third Embodiment of the present invention.
Figure 9A:
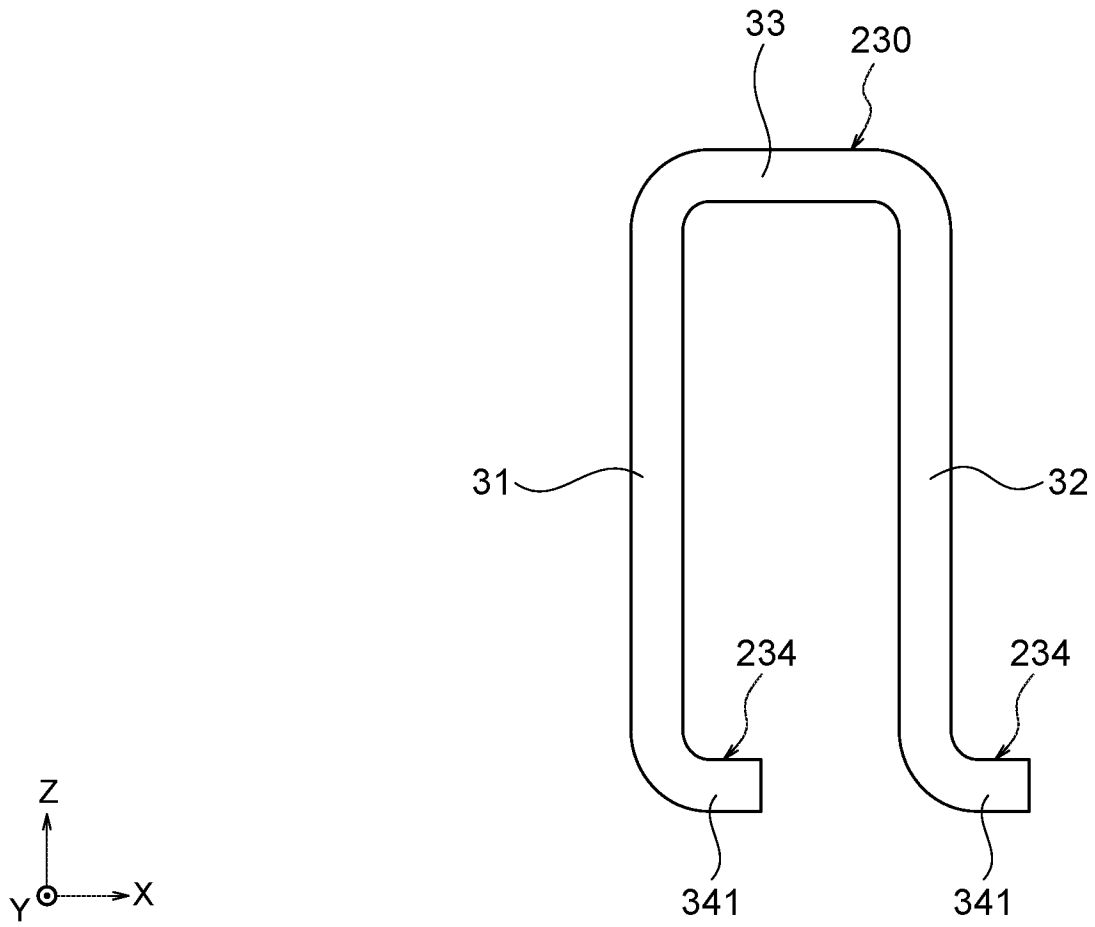
FIG. 9A is a perspective view of a coil of the coil device shown in FIG. 8.

As shown in FIG. 8, the coil device 210 includes a plurality of coils 230 (three coils in the present embodiment). As shown in FIG. 9A, each of the coils 230 has mountable parts 234, and the mountable parts 234 are different from the mountable parts 34 according to First Embodiment in that each of the mountable parts 234 has a bending part 341.

The bending part 341 owned by the mountable part 234 of the first lateral surface part 31 has a shape where the lower end of the first lateral surface part 31 is bent at a substantially right angle from the Z-axis direction to the X-axis direction.

The bending part 341 owned by the mountable part 234 of the second lateral part 232 has a shape where the lower end of the second lateral surface part 32 is bent at a substantially right angle from the Z-axis direction to the X-axis direction.

In all of the coils 230, when the multiple (three) coils 230 are arranged in the core 20 as shown in FIG. 8, the bending part 341 owned by the mountable part 234 of the first lateral part 231 and the bending part 341 owned by the mountable part 234 of the second lateral part 232 extend toward the same direction.

In the present embodiment, the mountable parts 234 (bending parts 341) of each of the coils 230 extend in the array direction (X-axis direction) of the multiple (three) coils 230. Thus, the coil device 210 can sufficiently be balanced via the mountable parts 234 of each of the coils 230 and can stably be mounted on an external circuit even if the coils 230 are narrow in the Y-axis direction.

In the present embodiment, the mountable parts 234 (bending parts 341) of either of the coils 230 next to each other and the mountable parts 234 (bending parts 341) of the other coil 230 extend toward substantially the same direction. Thus, it is possible to have a sufficiently large distance (or constant intervals) between the mountable parts 234 of either of the coils 230 next to each other and the mountable parts 234 of the other coil 230 and to prevent short-circuit failure between the coils 230 next to each other.

Fourth Embodiment

Except for the following matters, a coil device 310 according to Fourth Embodiment of the present invention is similar to the coil device 10 according to First Embodiment and demonstrates similar effects. Their overlapping matters are not explained. In the figures, common members are provided with common references.

Figure 10A:
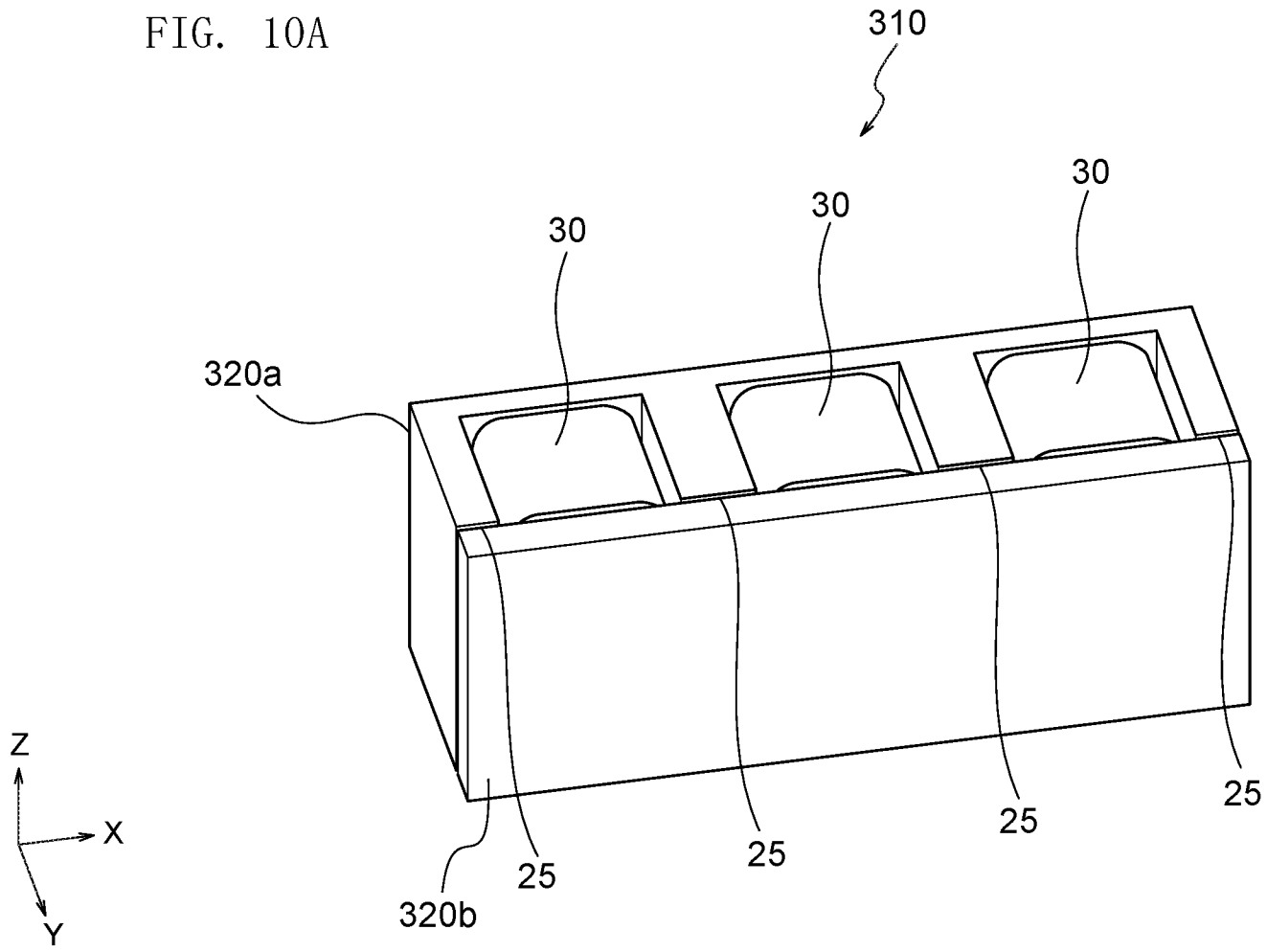
FIG. 10A is a perspective view of a coil device according to Fourth Embodiment of the present invention.
Figure 10B:
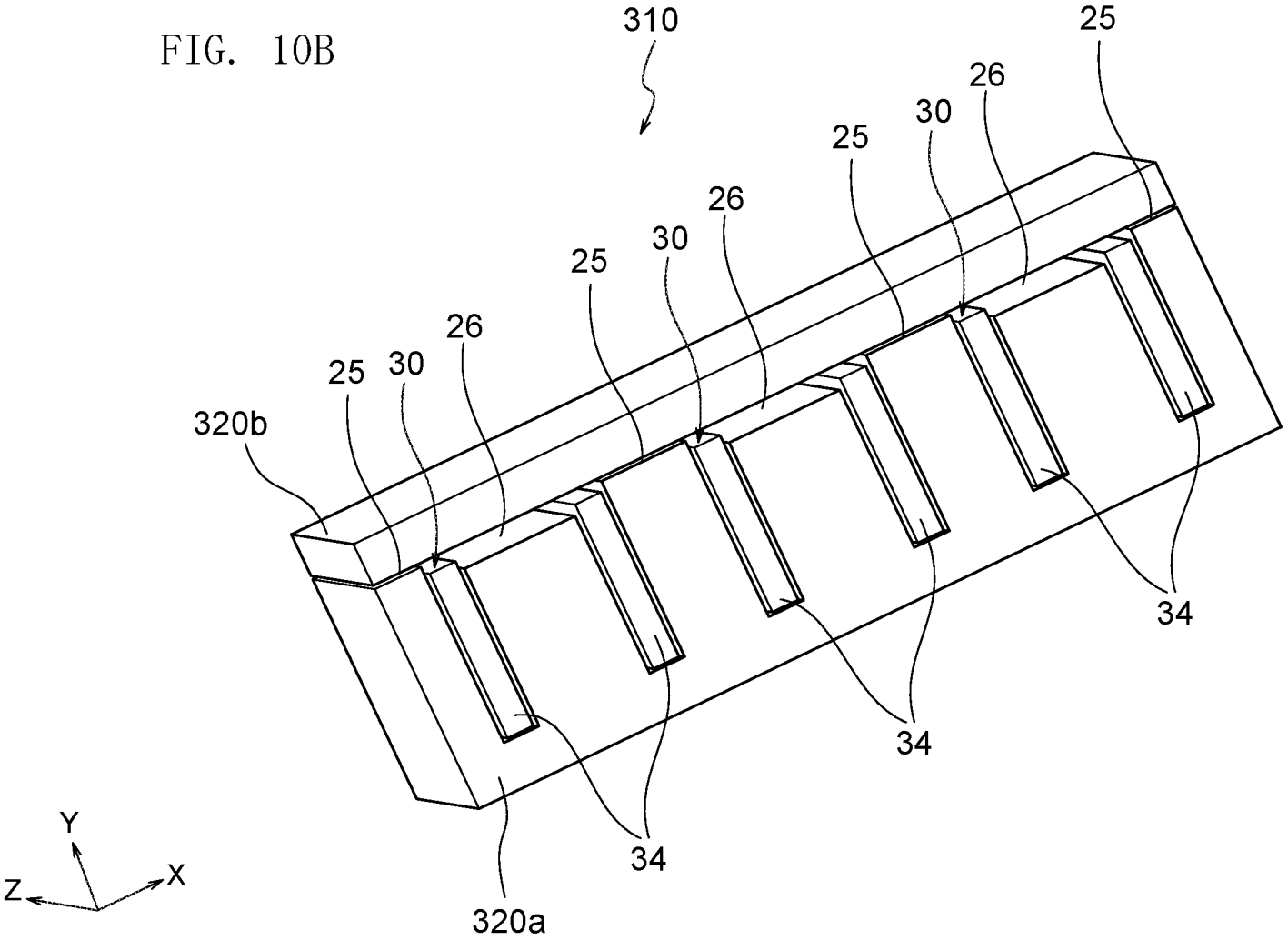
FIG. 10B is a perspective view of the coil device shown in FIG. 10A from a different angle.

As shown in FIG. 10A and FIG. 10B, the coil device 310 includes a first core 320*a* and a second core 320*b*. In the present embodiment, the first core 320*a* and the second core 320*b* do not have a corresponding shape and have different shapes.

Figure 11:
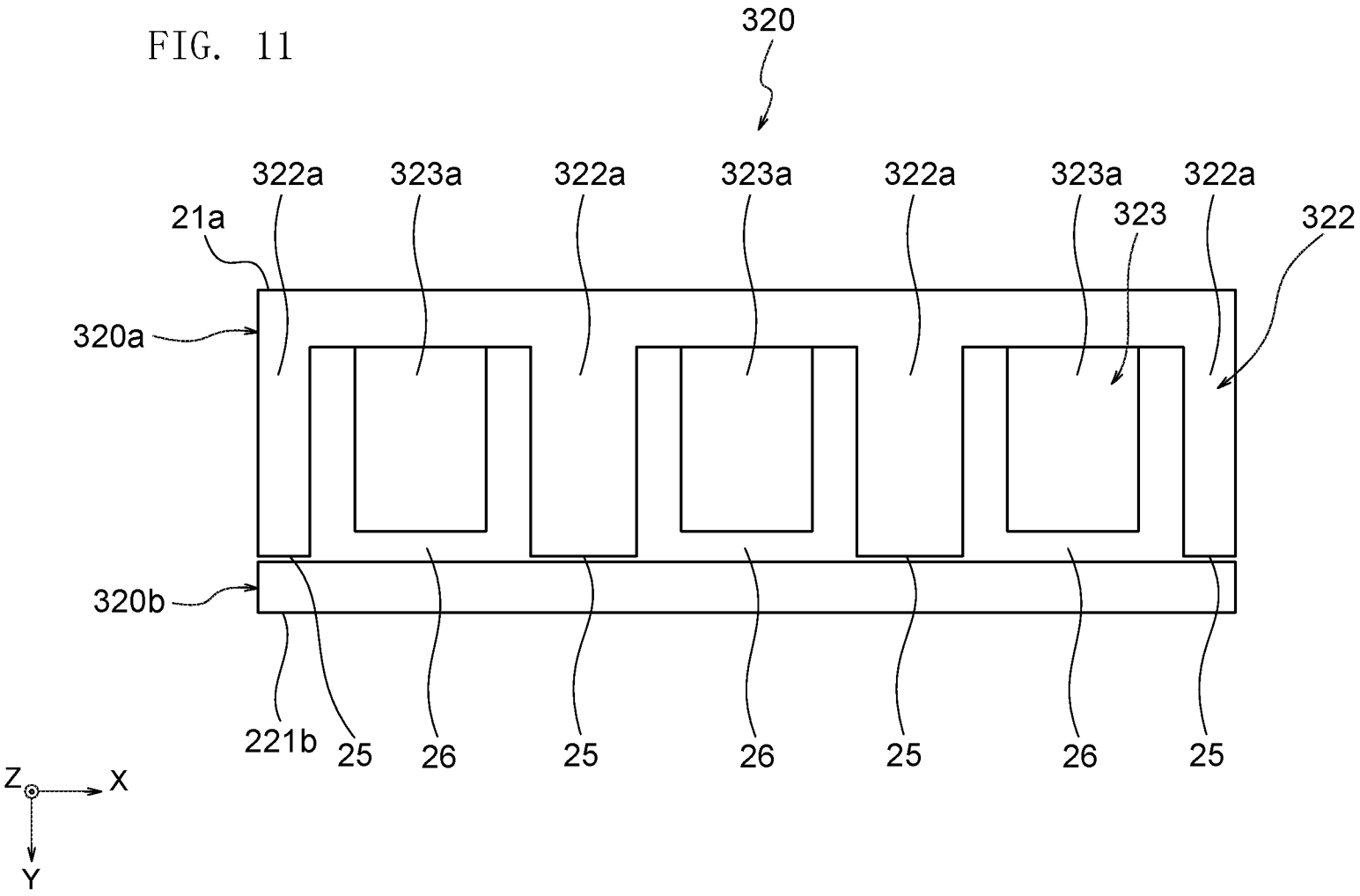
FIG. 11 is a top view of a core (first core and second core) of the coil device shown in FIG. 10A.

As shown in FIG. 11, the first core 320*a* has a plurality of first outer leg parts 322*a* (four first outer leg parts in the illustrated example) and a plurality of first inner leg parts 323*a* (three first inner leg parts in the illustrated example). The protrusion length (length in the longitudinal direction) of the first outer leg parts 322*a* is larger than that of the first outer leg parts 22*a* according to First Embodiment. In the present embodiment, the outer leg parts 322 are formed from only the first outer leg parts 322*a* of the first core 320*a*, and the inner leg parts 323 are formed from only the first inner leg parts 323*a* of the first core 320*a*.

The second core 320*b* does not have any components corresponding to the second outer leg parts 22*b* or the second inner leg parts 23*b* according to First Embodiment, but only has a second base part 221*b*. The second core 320*b* is formed from a flat (I-shaped) core.

When the first core 320*a* and the second core 320*b* are combined while facing each other in the Y-axis direction, the first gaps 25 with a predetermined with in the Y-axis direction are formed at the outer leg parts 322, and the second gaps 26 with a predetermined with in the Y-axis direction are formed at the inner leg parts 323, between the first core 320*a* and the second core 320*b*. Thus, even if the first core 320*a* and the second core 320*b* have different shapes like the present embodiment, effects similar to those of First Embodiment are obtained.

Incidentally, the present invention is not limited to the above-mentioned embodiments and may variously be changed within the scope of the present invention.

In the above-mentioned embodiments, the width G1 of the first gaps 25 in the Y-axis direction shown in FIG. 1C may be zero. Even in this case, G1<G2 can be obtained, and effects similar to those of the above-mentioned embodiments are obtained. In this case, since the first gaps 25 are not formed, the core 20 can be formed from one core (i.e., a core with only the second gaps 26).

In First Embodiment, six coils 30 are arranged in the coil device 10 as shown in FIG. 1A, but any plural number of coils 30 may be employed. This is also the case with Second Embodiment and Third Embodiment.

In First Embodiment, as shown in FIG. 2A, the first core 20*a* has a plurality of first outer leg parts 22*a* (seven first outer leg parts in the illustrated example of FIG. 2B), but the number of first outer leg parts 22*a* is not limited to seven. For example, the first core 20*a* may have only one first outer leg part 22*a*. In this case, however, the first outer leg part 22*a* is disposed between two first inner leg parts 22*a* and 22*a*. The number of first outer leg parts 22*a* may be two or more and six or less or may be eight or more. The above-mentioned matters are applicable to the second core 20*b*.

In the above-mentioned embodiments, the first gaps 25 extend linearly in the Y-axis direction as shown in FIG. 1C, but the first gaps 25 may extend diagonally to the Y-axis direction. This is also the case with the second gaps 26.

In Second Embodiment, the core 120 is structured by combining the symmetrical cores 120 and 120*b* having the same shape as shown in FIG. 5A, but the core 120 may be structured differently and may be structured by combining the asymmetrical cores 120*a* and 120*b* having different shapes. For example, the core 120 may be an EI type core consisting of an E-shaped core and a flat (I-shaped) core. In this case, the first gaps 25 and the second gaps 26 can be formed at positions where the legs of the E-shaped core and the plate surface of the flat core are combined, and effects similar to those of Second Embodiment are also obtained. This is also the case with Third Embodiment.

Figure 3B:
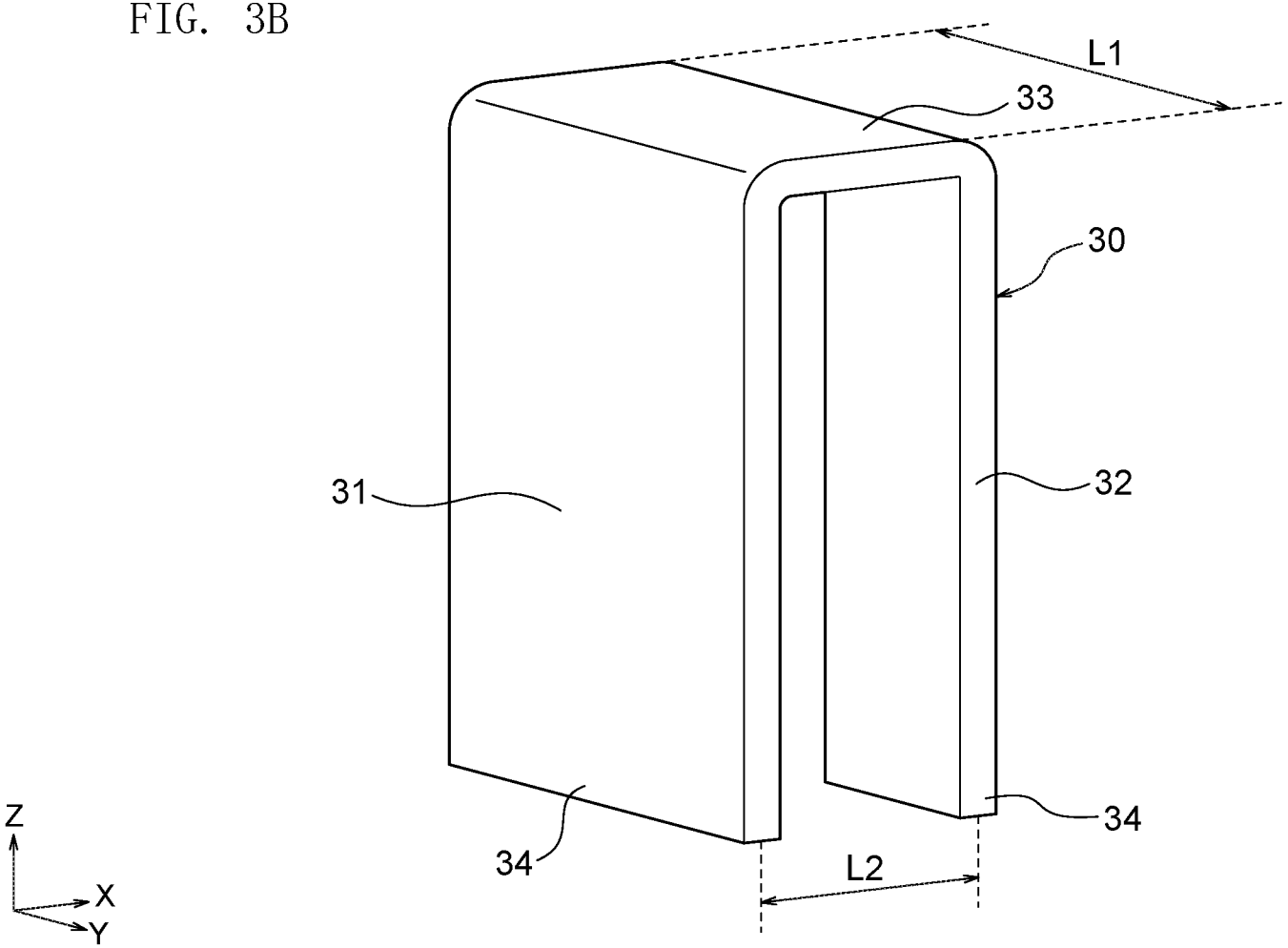
FIG. 3B is a perspective view of a modified example of the coil shown in FIG. 3A.
Figure 4:
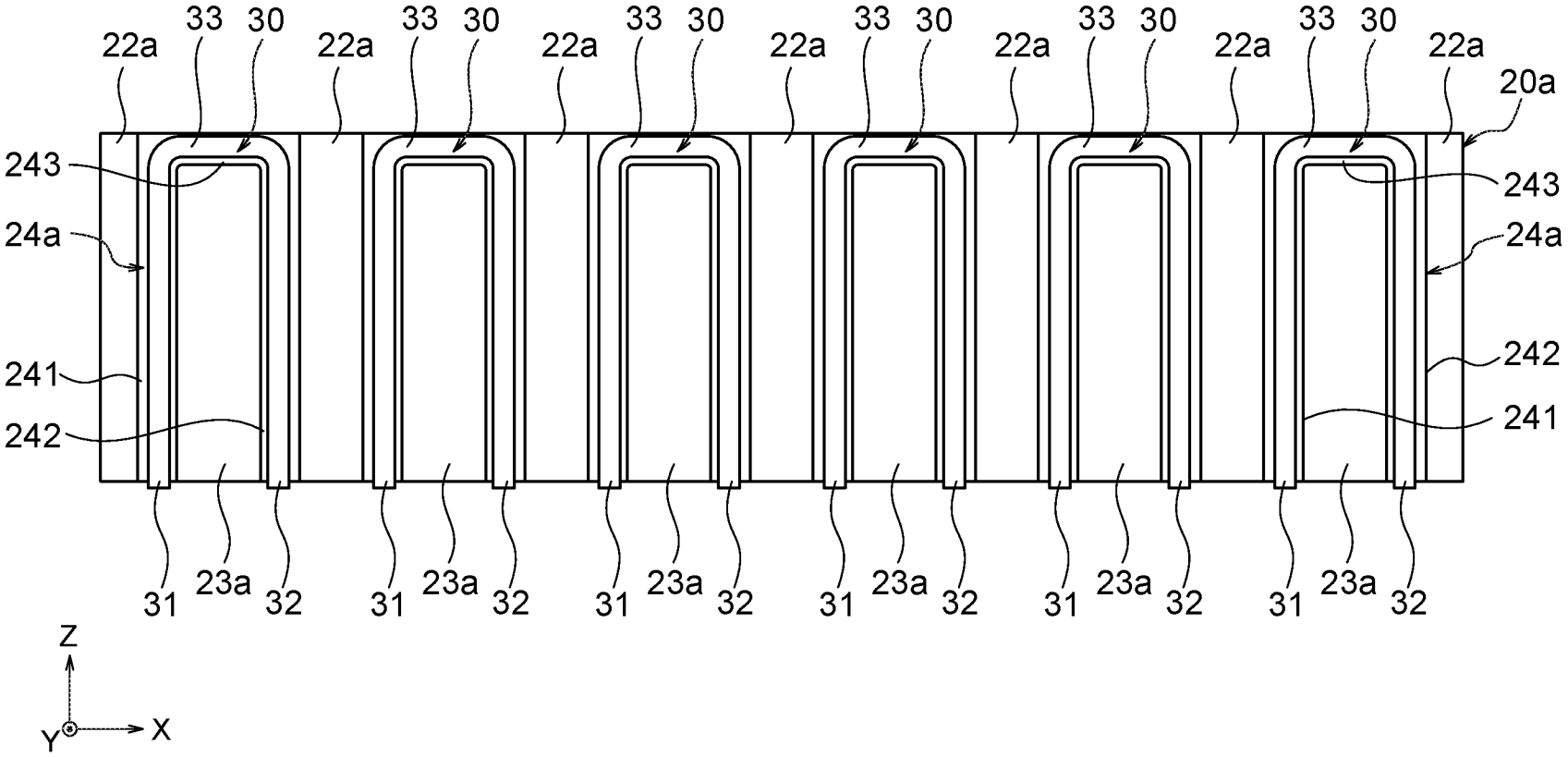
FIG. 4 is a cross-sectional view of the inside of the coil device shown in FIG. 1A.

In the above-mentioned embodiments, as shown in FIG. 3B, the width L1 of the coil 30 in the Y-axis direction may be larger than the length L2 of the coil 30 in a perpendicular direction (X-axis direction) to the height direction (Z-axis direction). In this structure, even if the multiple coils 30 are arranged in the core 20, the core 20 can be shorter in the array direction of the coils 30 (X-axis direction), and the coil device 10 can be downsized (thinned).

In the above-mentioned embodiments, the core 20 may include a top board covering tops of the multiple coils 30. In this case, the top board is attached to cover the upper end surfaces of the first outer leg parts 22*a* of the first and second cores 20*a* and 20*b* shown in FIG. 1A. In this structure, the top surface of the top board can be used as a suction surface, and the handling performance of the coil device 10 can be improved. Incidentally, the top board may be structured separately from the core 20 or integrally with the core 20.

Figure 9B:
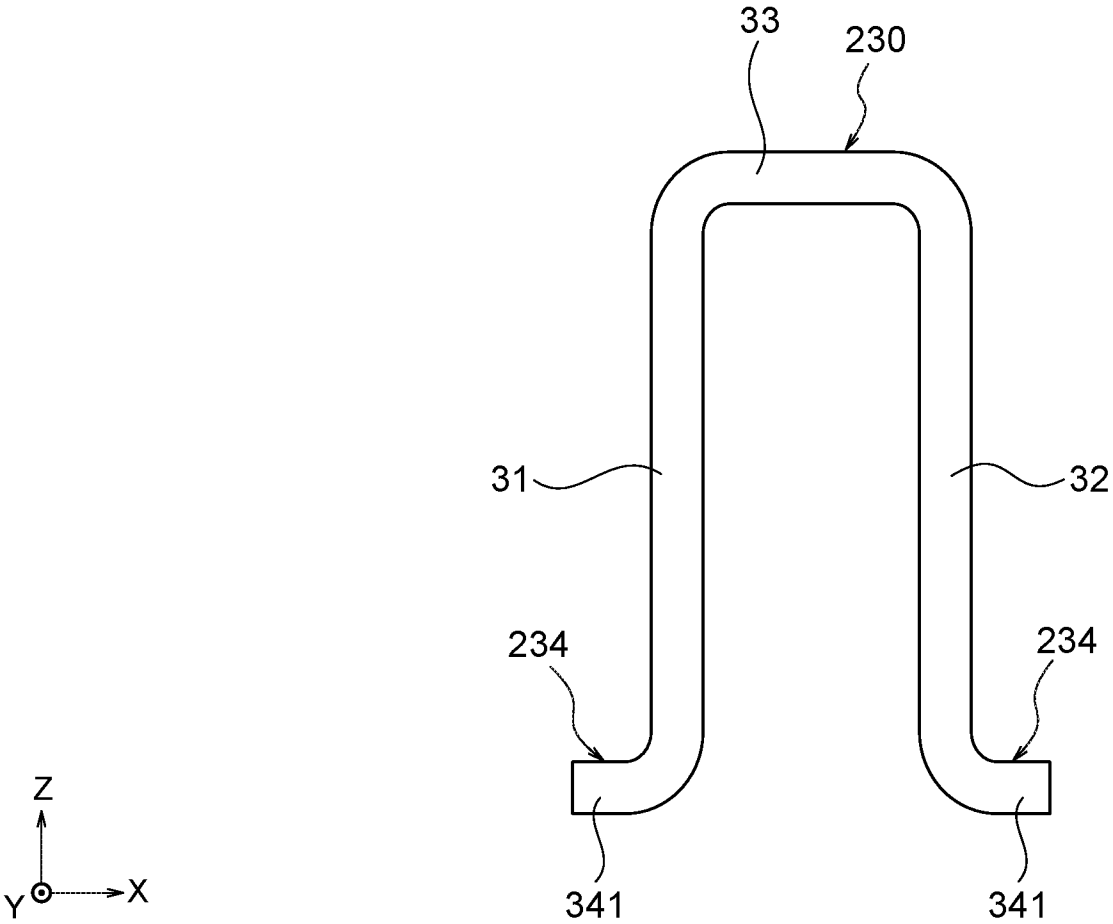
FIG. 9B is a perspective view of a modified example of the coil shown in FIG. 9A.

In Third Embodiment, as shown in FIG. 9B, the bending part 341 owned by the mountable part 234 of the first lateral part 231 and the bending part 341 owned by the mountable part 234 of the second lateral part 232 may extend toward different directions. In the illustrated example, the bending part 341 owned by the mountable part 234 of the first lateral part 231 and the bending part 341 owned by the mountable part 234 of the second lateral part 232 are directed opposite in the X-axis direction.

DESCRIPTION OF THE REFERENCE NUMERICAL

10, 110, 210, 310 . . . coil device
20, 120, 320 . . . core
20*a*, 120*a*, 320*a* . . . first core
20*b*, 120*b*, 320*b* . . . second core
21*a* . . . first base part
21*b* . . . second base part
22, 322 . . . outer leg part
22*a*, 322*a* . . . first outer leg part
22*b* . . . second outer leg part
23, 323 . . . inner leg part
23*a*, 323*a* . . . first inner leg part
23*b* . . . second inner leg part
24*a* . . . first groove part
24*b* . . . second groove part
241 . . . first lateral part
242 . . . second lateral part
243 . . . top part
25 . . . first gap
26 . . . second gap
127 . . . notch
30, 130, 230 . . . coil
31 . . . first lateral surface part
32 . . . second lateral surface part
33 . . . upper surface part
34, 134, 234 . . . mountable part
340 . . . protrusion part
341 . . . bending part

What is claimed is:

1. A coil device comprising:
a core; and
a plurality of coils arranged in the core, wherein
a distance of a second gap formed by portions of the core located inside at least one of the coils is larger than that of a first gap formed by other portions of the core located between the coils next to each other,
the core includes an outer leg part formed between the coils next to each other and an inner leg part formed in at least one of the coils,
the first gap is formed at the outer leg part,
the second gap is formed at the inner leg part,
the core includes a first core and a second core,
the first core has at least one outer leg part and a plurality of inner leg parts,
the second core has at least one outer leg part and a plurality of inner leg parts,
the first gap is formed between the outer leg part of the first core and the outer leg part of the second core, and
the second gap is formed between at least one of the inner leg parts of the first core and at least one of the inner leg parts of the second core.

2. The coil device according to claim 1, wherein mountable parts connectable to an external circuit are formed on both ends of at least one of the coils.

3. The coil device according to claim 2, wherein the mountable parts are partly exposed from a lateral surface of the core in its width direction.

4. The coil device according to claim 1, wherein the core includes a top board covering tops of the plurality of coils.

5. The coil device according to claim 1, wherein a width of at least one of the coils is larger than a length of at least one of the coils perpendicular to its height direction.

6. A coil device comprising:
a core; and
a plurality of coils arranged in the core, wherein
a distance of a second gap formed by portions of the core located inside at least one of the coils is larger than that of a first gap formed by other portions of the core located between the coils next to each other,
the first gap extends in a direction connecting the coils next to each other,
the second gap extends in a direction connecting portions of an inner circumferential surface of at least one of the coils,
the core includes an outer leg part formed between the coils next to each other and an inner leg part formed in at least one of the coils,
the first gap is formed at the outer leg part,
the second gap is formed at the inner leg part,
the core includes a first core and a second core,
the first core has at least one outer leg part and a plurality of inner leg parts,
the second core has at least one outer leg part and a plurality of inner leg parts,
the first gap is formed between the outer leg part of the first core and the outer leg part of the second core, and
the second gap is formed between at least one of the inner leg parts of the first core and at least one of the inner leg parts of the second core.

7. The coil device according to claim 6, wherein mountable parts connectable to an external circuit are formed on both ends of at least one of the coils.

8. The coil device according to claim 7, wherein the mountable parts are partly exposed from a lateral surface of the core in its width direction.

9. The coil device according to claim 6, wherein the core includes a top board covering tops of the plurality of coils.

10. The coil device according to claim 6, wherein a width of at least one of the coils is larger than a length of at least one of the coils perpendicular to its height direction.

11. A coil device comprising:
a core; and
a plurality of coils arranged in the core, wherein
a distance of a second gap formed by portions of the core located inside at least one of the coils is larger than that of a first gap formed by other portions of the core located between the coils next to each other,
mountable parts connectable to an external circuit are formed on both ends of at least one of the coils,
the core includes an outer leg part formed between the coils next to each other and an inner leg part formed in at least one of the coils,
the core includes a first core and a second core,
the first core has at least one outer leg part and a plurality of inner leg parts,
the second core has at least one outer leg part and a plurality of inner leg parts,
the first gap is formed between the outer leg part of the first core and the outer leg part of the second core, and
the second gap is formed between at least one of the inner leg parts of the first core and at least one of the inner leg parts of the second core.

12. The coil device according to claim 11, wherein the mountable parts are partly exposed from a lateral surface of the core in its width direction.

13. The coil device according to claim 11, wherein the mountable parts are not exposed from a lateral surface of the core in its width direction.

14. The coil device according to claim 11, wherein the mountable parts extend in an array direction of the plurality of coils.

15. The coil device according to claim 11, wherein the mountable parts of either of the coils next to each other and the mountable parts of the other coil extend in substantially the same direction.

16. The coil device according to claim 11, wherein the core includes a top board covering tops of the plurality of coils.

17. The coil device according to claim 11, wherein a width of at least one of the coils is larger than a length of at least one of the coils perpendicular to its height direction.

* * * * *